US005395094A

United States Patent [19]

Areaux

[11] Patent Number: 5,395,094

[45] Date of Patent: Mar. 7, 1995

[54] MEANS OF CONVEYING MOLTEN METAL FROM ONE PLACE TO ANOTHER IN A METAL-MELTING FURNACE WITH SIMULTANEOUS ALLOYING OF THE MELT

[75] Inventor: Larry D. Areaux, Nathrop, Colo.

[73] Assignee: Premelt Pump, Inc., Kalamazoo, Mich.

[21] Appl. No.: 257,797

[22] Filed: Jun. 10, 1994

Related U.S. Application Data

[60] Division of Ser. No. 49,837, Apr. 19, 1993, Pat. No. 5,397,378, which is a continuation-in-part of Ser. No. 799,114, Nov. 27, 1991, Pat. No. 5,203,910.

[51] Int. Cl.[6] ..... C21C 7/00

[52] U.S. Cl. ..... 266/233; 75/708; 75/511; 266/200; 266/208; 266/220

[58] Field of Search ..... 75/708, 511; 266/200, 266/208, 220, 233

[56] References Cited

U.S. PATENT DOCUMENTS

| | | | |
|---|---|---|---|
| 3,125,440 | 3/1964 | Hornak | 75/509 |
| 3,479,022 | 11/1969 | Coupette | 75/511 |
| 3,867,132 | 2/1975 | Perry | 266/208 |
| 4,298,192 | 11/1981 | Barbakadze | 75/533 |

*Primary Examiner*—Peter D. Rosenberg
*Attorney, Agent, or Firm*—Gordon W. Hueschen

[57] ABSTRACT

A method, for the conveyance of molten metal from one place to another, in a high-temperature molten metal pool in a metal-melting furnace or out of said molten metal pool, employing an at least partially-inclined elongated conveying conduit and gas feed means for feeding inert gas into the lower end of the conveying conduit and thereby inducing a flow of molten metal in and through said conveying conduit, is disclosed, along with suitable apparatus for carrying out the said method wherein the parts or elements coming into contact with the high-temperature molten metal pool are of a suitable refractory material. According to the present invention, the molten metal is alloyed simultaneously with its conveyance, the same inert gas being employed for both conveying the molten metal and for entrainment of the alloying metal.

31 Claims, 10 Drawing Sheets

MEANS OF CONVEYING MOLTEN METAL FROM ONE PLACE TO ANOTHER IN A METAL-MELTING FURNACE WITH SIMULTANEOUS ALLOYING OF THE MELT

The present application is a division of my prior-filed application Ser. No. 08/049,837, filed Apr. 19, 1993, now U.S. Pat. No. 5,397,378, which in turn is a continuation-in-part of Ser. No. 07/799,114, filed Nov. 27, 1991, now U.S. Pat. No. 5,203,910, issued Apr. 20, 1993.

BACKGROUND OF THE INVENTION

1. Field of the Invention

Movement of molten metal in a mass or pool of molten metal in a metal-melting furnace, establishing and maintaining efficient circulation of molten metal therein, movement of said molten metal from a hotter area to a colder area and thereby enhancing the efficient melting of metal chips in the molten metal mass or pool.

According to the present invention, not only is the molten metal circulated but, simultaneously with the circulation, alloying of the melt is conveniently and efficiently effected.

2. Prior Art

For the efficient melting of metal chips, especially scrap metal chips, particularly brass, aluminum, magnesium, titanium, and alloys thereof, by introduction of the same into a pool or mass of molten metal, usually the metal of which they are formed or an alloy thereof, as in the feed or charge well of a metal-melting furnace, e.g., a reverberatory furnace or the like, it is not only desirable but necessary to circulate molten metal from the hottest area of the metal-melting furnace, that is, the main chamber thereof, out into side chambers or wells, and especially into the feed or charge well, on a continuous basis. According to present practice of the art, a molten metal circulating pump, fabricated at least partially of graphite, is the means of choice. Such a pump comprises a submerged discharge scroll which houses an impeller mounted on a vertical shaft which rides in silicon carbide bearings. The shaft, upon which the pump impeller is mounted, is driven by an air or electric motor located atop the pump several feet above the molten metal bath or pool. An alternate use for the same type of pump is to elevate molten metal above the level of the molten metal bath or pool for transfer into other containers, such as a refractory-lined ladle or into a trough which is covered and sometimes heated, referred to in the trade as a "launder". Such a device is also employed to transfer molten metal from one furnace to another. Inasmuch as graphite is refractory, i.e., heat-stable and resistant to attack by most metal alloys as well as characterized by good non-wetting characteristics, such graphite metal circulating pumps have broad acceptance in the metal melting and reclaiming industry. However, due to the fragile nature of the graphite parts, the close tolerance of the pump parts, and the frequent requirement of pulling the pump for cleaning, the wear and breakage expenses account for very high maintenance costs, which on an annual basis often exceed twice the initial cost of the pump. Accordingly, the search for improvements in the molten metal circulating pump design and in general for some means of transporting or conveying molten metal from one place to another, especially in a molten metal bath or pool in a metal-melting furnace, has had high priority. Despite the efforts to date, no effective means or method for moving or conveying molten metal from one place to another, especially in a molten metal bath or pool in a metal-melting furnace, have been devised, despite a long-standing need for the same in the industry.

In addition, the currently-accepted practice for alloying metals, such as silicon, into molten aluminum or other molten metal, is simply to melt large pieces or chunks of metal, such as the silicon, directly into a molten metal bath or mass of the aluminum or other metal. The process is slow and tedious and often results in a loss of the alloying metal to oxidation during the alloying procedure. Moreover, during the time consumed by the alloying procedure, the molten metal in the furnace is unsuitable and unavailable for use, which can increase costs, e.g., as from an increase in casting time. As a further inconvenience of present practice, it is necessary to add or otherwise introduce the alloying metal or metals manually to ensure that the correct percentage or weight of the alloying metal or metals is being introduced into the furnace and melted and alloyed therein with the molten metal mass into which it is being introduced. The present invention represents a considerably advantageous improvement, both from the standpoint of efficiency and economy, in the alloying of metals such as aluminum as well as a considerably advantageous improvement in the method and means for conveying the molten metal and, in fact, provides method and means for effecting both results conveniently and simultaneously.

OBJECTS OF THE INVENTION

It is an object of the present invention to provide a novel method for the movement or conveyance of molten metal from one point to another, especially from one point in a molten metal pool or bath in a metal-melting furnace to another point in said molten-metal pool, or to a point outside of said molten metal pool, usually to a point adjacent said metal-melting furnace. A further object is the provision of apparatus for use in the process, and particularly such apparatus as will permit the attainment of the objectives set forth in the foregoing with relation to the method of the invention. A salient objective of the present invention is to provide an improved method and apparatus for the alloying of molten metals such as aluminum simultaneously with their convenient, efficient, and economic conveyance from place to place while in the molten state. Other objects of the invention will become apparent hereinafter, and still other objects will be apparent to one skilled in the art to which this invention pertains.

SUMMARY OF THE INVENTION

What I believe to be my invention, then, inter alia, comprises the following, singly or in combination:

An improved method for the conveyance of molten metal from one place to another in a molten metal pool or mass in a metal-melting furnace or out of said molten metal pool, while simultaneously alloying the same, comprising the steps of:

providing an elongated conveying conduit having a lower end and an upper end, at least a portion of said conduit being inclined upwardly from the horizontal, providing a gas feed means having a gas inlet port and a gas exit port, positioning the exit port of said gas feed means with respect to the lower end of said conveying conduit so as to enable release of gas from said exit port into said conveying conduit at or adjacent its lower end, submerging the exit port of said gas feed means and the lower end of said conveying conduit in a molten metal mass or pool, introducing inert gas containing finely-divided alloying metal entrained therein into said gas feed means and causing said gas to emerge from the exit port thereof into said conveying conduit at or adjacent its lower end and to rise up the incline therein, and inducing concomitant flow of molten metal in said conveying conduit by means of said gas exiting from the exit port of said gas feed means and into said conveying conduit at or adjacent its lower end and rising up the incline therein; such a method wherein the method is carried out in a metal-melting furnace; such a method wherein the molten metal is caused to be conveyed from a lower portion of said molten metal pool to a higher portion of said molten metal pool; such a method wherein the molten metal is caused to be conveyed from a hotter portion of said molten metal pool to a colder portion of said molten metal pool; such a method wherein the molten metal is caused to be conveyed from one well or chamber of a metal-melting furnace to another well or chamber thereof; such a method wherein the molten metal is caused to be conveyed into a charge well of the furnace; such a method wherein the molten metal is caused to be conveyed from a hotter portion of said molten metal pool into a colder portion of said molten metal pool in a charge well of said furnace; such a method wherein the molten metal is caused to be conveyed from a hotter area in the main chamber of a metal-melting furnace to another chamber of said furnace; such a method wherein the conveying conduit is located in a passageway in a wall of the metal-melting furnace; such a method wherein the conveying conduit is provided as a part of a wall of the metal-melting furnace; such a method wherein a plurality of conveying conduits are employed; such a method wherein said plurality of conveying conduits are provided as a part of a wall of a metal-melting furnace; such a method wherein the metal-melting furnace has chambers of different depths, the conveying conduit is positioned between chambers of different depths, and the molten metal is caused to be conveyed from the deeper of the two chambers into the chamber having the lesser depth; such a method wherein the molten metal pool comprises magnesium or aluminum or an alloy thereof; such a method wherein the inert gas comprises nitrogen or argon; such a method wherein the submerged portion of said gas feed means and said conveying conduit are of high-temperature molten metal resistant refractory material; such a method including the step of arranging the exit port of said gas feed means so as to be in communication with the interior of the conveying conduit at or adjacent the lower end thereof; such a method wherein the temperature of the inert gas is between about −50° and about −100° F.; such a method wherein the temperature of the inert gas is at about −80° F.; such a method wherein the pressure at which the inert gas is released at the exit port of the inert gas feed means is up to about 150 psi; such a method wherein the pressure at which the inert gas is released at the exit port of the inert gas feed means is between about 20 and about 60 psi; such a method wherein the temperature of the molten metal bath is between about 1200° and about 1500° F.; such a method wherein the temperature of the inert gas is between about −50° and about −100° F. and the pressure under which the inert gas is released from the exit port of the inert gas feed means is between about 20 and about 60 psi; such a method wherein the temperature of the molten metal pool is between about 1250° and about 1450° F.; such a method wherein the conveying conduit has an inclined reach from its lower end to its upper end; such a method wherein the conveying conduit has an inclined reach and a substantially horizontal reach; such a method wherein the conveying conduit has an inclined reach and a substantially horizontal reach at the upper end thereof; such a method wherein the conveying conduit has an inclined reach and a substantially horizontal reach at both the upper end thereof and the lower end thereof; such a method wherein the conveying conduit is in the form of a flattened Z; such a method wherein the conveying conduit has an inclined reach and a substantially horizontal reach at an end of said inclined reach, and wherein the inclined reach and the substantially horizontal reach lie in different vertical planes; and such a method wherein the conveying conduit has an inclined reach and a substantially horizontal reach at a lower end thereof, and wherein inert gas is introduced into said conveying conduit at or near the bottom or commencement of its inclined reach.

Moreover, molten metal conveying means suitable for conveying molten metal from one place to another in a molten metal pool or mass in a metal-melting furnace or out of said molten metal pool while simultaneously alloying the same, comprising in combination:

inert gas feed means having a gas inlet port and a gas exit port, at least a portion thereof adapted to be submerged in a molten-metal bath comprising high-temperature and molten-metal resistant material, means for entraining finely-divided alloying metal in said inert gas, an elongated conveying conduit of high-temperature molten-metal resistant material having a lower end and an upper end, at least a portion of said conduit being inclined upwardly from the horizontal, the exit port of said inert gas feed means being associated with said conveying conduit at or near the lower end thereof so as to enable release of inert gas from said exit port of said gas feed means into said conveying conduit at or adjacent a lower end thereof, thereby to induce concomitant flow of molten metal in said conveying conduit and simultaneous alloying of the molten metal mass; such a means adapted to be mounted in a molten metal pool in the interior of a metal-melting furnace; such a means supported in place in a molten metal mass or pool in a metal-melting furnace; such a means wherein the molten metal mass or pool is in a metal-melting furnace having one chamber deeper than another chamber, and wherein the lower end of said conveying conduit is in the deeper chamber and the upper end of said conveying conduit is in said shallower chamber; such a means mounted in a passageway in a wall between chambers or wells of a metal-melting furnace; such a means built into a wall between chambers or wells of a metal-melting furnace; such a means comprising a single conveying conduit; such a means comprising a plurality of conveying conduits; such a means comprising a plurality of conveying conduits and wherein said gas feed means communicates with said plurality of conveying conduits at or near the lower end thereof; such a means wherein the conveying conduit is supported in said wall by means of a sleeve around the exterior thereof; such a means wherein the exit port of said gas feed means is in communication with the interior of the conveying conduit at or adjacent the lower end thereof; such a means wherein the conveying conduit has an inclined reach from its lower end to its upper end; such a means wherein the conveying conduit has an inclined reach and a substantially horizontal reach; such a means wherein the conveying conduit has an inclined reach and a substantially horizontal reach at the upper end thereof; such a means wherein the conveying conduit has an inclined reach and a substantially horizontal reach at both the upper end thereof and the lower end thereof; such a means wherein the conveying conduit is in the form of a flattened Z; such a means wherein a portion of the gas feed means is comprised as a part of a hanger adapted to support the conveying conduit in a molten metal pool; such a means wherein the gas feed means comprises a block which supports said conveying conduit, said block having therein a passageway comprising the exit port of said gas feed means; such a means wherein said passageway is a circular passageway surrounding said conveying conduit and wherein said exit port is located in said circular passageway; such a means wherein the conveying conduit has an inclined reach and a substantially horizontal reach at an end of said inclined reach, and wherein the inclined reach and the substantially horizontal reach lie in different vertical planes; such a means wherein the conveying conduit has an inclined reach and a substantially horizontal reach at a lower end thereof, and wherein inert gas is introduced into said conveying conduit at or near the bottom or commencement of its inclined reach; such a means wherein the conveying conduit is at least partially in the form of a passageway in a block of refractory material; such a means comprising a plurality of conveying conduits at least partially in the form of passageways in a block of refractory material, and such a means wherein the gas inlet means also at least partially comprises a passageway in said block of refractory material.

Moreover, such a method wherein inert gas is retained at the surface of the molten metal mass to impede or prevent oxidation thereof, and such a method wherein the alloying metal is selected from the group consisting of silicon, strontium, magnesium, manganese, iron, chromium, titanium, zinc, copper, and admixtures or alloys thereof, such a method wherein the molten metal being alloyed is aluminum and the alloying metal is other than aluminum alone, such a method wherein the alloying metal is in the form of particles having a particle size of 0.01 to 0.1 inch on their greatest dimension, such a method wherein the alloying metal is in the form of particles having a particle size of about 0.25 millimeter to about 2.5 millimeters on their greatest dimension, such a method wherein the alloying metal is in the form of particles having a particle size between 10 mesh and 100 mesh (U.S. Standard Screen Series), and such a method wherein the alloying metal is pulverized or in powder form.

Further, such a means wherein the inert gas feed means is adapted to provide a pressure of inert gas at the exit port of the inert gas feed means of up to about 150 psi, such means wherein the inert gas feed means is adapted to provide a pressure of inert gas at the exit port of the inert gas feed means of between about 20 and about 60 psi, such means wherein the means for entraining the finely-divided alloying metal in said inert gas is adapted to entrain an alloying metal selected from the group consisting of silicon, strontium, magnesium, manganese, iron, chromium, titanium, zinc, copper, and admixtures or alloys thereof, such means wherein the means for entraining the finely-divided alloying metal in said inert gas is adapted to entrain the alloying metal in pulverized or powder form, such means wherein the means for entraining the finely-divided alloying metal is adapted to entrain the alloying metal in the form of particles having a particle size of 0.01 to 0.1 inch on their greatest dimension, such means wherein the means for entraining the finely-divided alloying metal is adapted to entrain the alloying metal in the form of particles having a particle size of about 0.25 millimeter to about 2.5 millimeters on their greatest dimension, and finally such means wherein the means for entraining the finely-divided alloying metal is adapted to entrain the alloying metal in the form of particles having a particle size between 10 mesh and 100 mesh (U.S. Standard Screen Series).

DEFINITIONS

For purposes of the present invention and application, the following terms have the following meanings:

Convey—To cause to pass from one place to another, in the context of the present application from one place to another within a molten metal bath, usually contained in a metal-melting furnace, and frequently from one chamber thereof to another, or from the molten metal pool in the metal-melting furnace out of said molten metal pool, e.g., to an adjacent container, ladle, launder, or another metal-melting furnace.

Conduit—This term has its usual meaning of a pipe, tube, tile, or the like, and is frequently used herein as the second word in the term "conveying conduit", which is the essence of the present invention.

Concomitant—Accompanying, but not in a subordinate way.

Refractory material—Such material as is immune to reaction, especially to high temperatures and, in the present case, also to the molten metal involved and to which the material may be exposed.

Other terms will find their definitions at or near the point where employed in the Specification, and still other terms will require no explanation whatever as they will have their usual meanings and in any event will be readily understood by one skilled in the art.

GENERAL DESCRIPTION OF THE INVENTION

The present invention relates to apparatus for the movement, transport, or conveyance of molten metal from one place to another by means which involves no moving parts. This apparatus is capable of moving molten metal upwardly as well as horizontally, and utilizes a relatively low quantity of inert gas as the propellant, representatively argon and nitrogen, both of which are currently employed in the production of metal alloys and their refinement. Both of these inert gases may be satisfactorily employed according to the present invention. To assure a high purity of the inert gas, the gas may conveniently be maintained under high pressure at temperatures which may be as low as −100° F., usually between about −50° and −80° F., which purity assures the absence of water vapor, which of course could result in explosive reactions if introduced into a molten metal bath or pool.

The present invention comprises an elongated conveying conduit which is inclined along at least a portion thereof, constructed of graphite or other suitable refractory material, inert gas feed means suitable for delivering the inert gas to the conveying conduit at or near the lower end thereof and usually from above the molten metal bath, and may advantageously include a control system for monitoring the delivery of the inert gas and the rate at which delivered through an exit port which is adjacent to and generally in communication with the interior of the conveying conduit at or near the lower end thereof. Inert gas under pressure up to about 150 psi or so, and generally between about 20 and about 60 psi, at the exit port, often conveniently about 30 psi at the exit port, is thus delivered to a location referred to as the exit port near the bottom of the gas delivery means, and at or near the lower end of the conveying conduit, where the inert gas is released from the exit port into the said conveying conduit. The inert gas then forms many bubbles within the inside diameter of the conveying conduit as it enters at or near the lower end thereof, and the pressure exerted on the bubbles of inert gas, especially when the apparatus is located at or near the bottom of molten metal bath or pool in a metal-melting furnace, creates sufficient force to cause the gas bubbles to seek lower pressure which commences to exist as the gas bubbles rise up the inclined portion of the conveying conduit. As the inert gas rises, it not only pushes a column of molten metal in front of it, but it also creates a negative pressure or vacuum behind the bubbles, causing the inlet of the conveying conduit at the lower end thereof and toward the bottom of the molten metal mass or pool in the metal-melting furnace to fill and refill with additional molten metal. As additional inert gas is provided by means of the gas feed means and released from the exit port thereof into the conveying conduit at or near the lower end thereof, a portion of the molten metal is lifted, causing a molten metal flow to occur from one location to another. A secondary boost in performance of this conveying means is achieved when the very cold inert gas (temperature usually between ca. −50° and −100° F.) is released into the molten metal, which is usually at a temperature between about 1200° and 1500° F., generally between about 1250° and about 1450° F., from the exit port of the gas feed means into the conveying conduit at or near the lower end thereof, which produces a thermodynamic force due to the rapid expansion of the gas as the cold inert gas mixes with the high temperature molten metal. By operating in this manner and employing the apparatus of the present invention, the method of the present invention is efficiently and economically achieved without the necessity of any moving parts, and the molten metal is conveniently transported or conveyed from one location to another either in the molten metal bath or pool or from a position in the molten metal pool out of the same.

As pointed out in the foregoing, the introduction of the cold inert gas into the hot molten metal results in a strong thermodynamic force, which also exerts its effect upon the efficiency of the method and apparatus of the invention, which results from the rapid expansion of the inert gas as it mixes with the high-temperature molten metal into which it is introduced.

The apparatus and method of the present invention have obvious and important application wherever molten metals require conveyance or transport or movement, and will find especially important applications wherever electricity is limited or unavailable, and particularly where high temperatures, corrosion, and abrasive materials such as molten metals are involved, and in any such cases where conveyance of the involved fluid in a vertical direction, that is, a direction inclined vertically from the horizontal, is or can be conveniently involved or employed.

According to the present invention, finely-divided particles of an alloying metal, e.g., silicon, strontium, magnesium, manganese, iron, chromium, titanium, zinc, copper, or admixtures or alloys thereof with aluminum or with each other, are entrained in the inert gas stream, and thereby introduced along with the inert gas into the molten metal mass, e.g., the molten metal mass of aluminum. This results in a highly-efficient method of alloying, e.g., introducing silicon or other alloying metal, into the molten metal, for example, when pure primary aluminum (99.97% aluminum) is subjected to the process, a high-grade aluminum alloy such as A-356, which contains over ten percent (10%) silicon by weight, can be readily produced. Common alloys of aluminum with the following alloying metals are representatively as follows:

| | |
|---|---|
| magnesium | 0.01 to 2.5% by weight |
| copper | 0.01 to 4.5% by weight |
| manganese | 0.01 to .5% by weight |
| zinc | 0.01 to 5.5% by weight |
| titanium | 0.01 to 1% by weight |
| chromium | 0.01 to .5% by weight |
| iron | 0.01 to .1% by weight |
| strontium | 0.01 to .1% by weight |
| silicon | 1 to 20% by weight |

According to the method and means of the present invention, such results are attained whether the inert gas is fed into the melt according to the normal conditions and pressures, e.g., using continuous flow of the inert gas, or whether the inert gas is fed into the melt with pulsation, that is, intermittently, or whether the inert gas is introduced into the melt at a supersonic velocity with concurrent simultaneous degassing of the melt, and whether a single or multiple nozzle inert gas feed system, e.g., such as shown in FIGS. 10–12, is employed.

Reference is made to FIGS. 19 and 20 for a depiction of the method and means employed for this unique manner of alloying molten metal, e.g., molten aluminum.

Numerous modifications in both the method and apparatus of the invention, as well as specific embodiments and advantages thereof in a particular case, will be readily apparent to one skilled in the art, especially from the more detailed description of the invention which follows.

DESCRIPTION OF THE DRAWINGS

Reference is now made to the drawings, wherein.

DETAILED DESCRIPTION OF THE INVENTION

Figure 1:
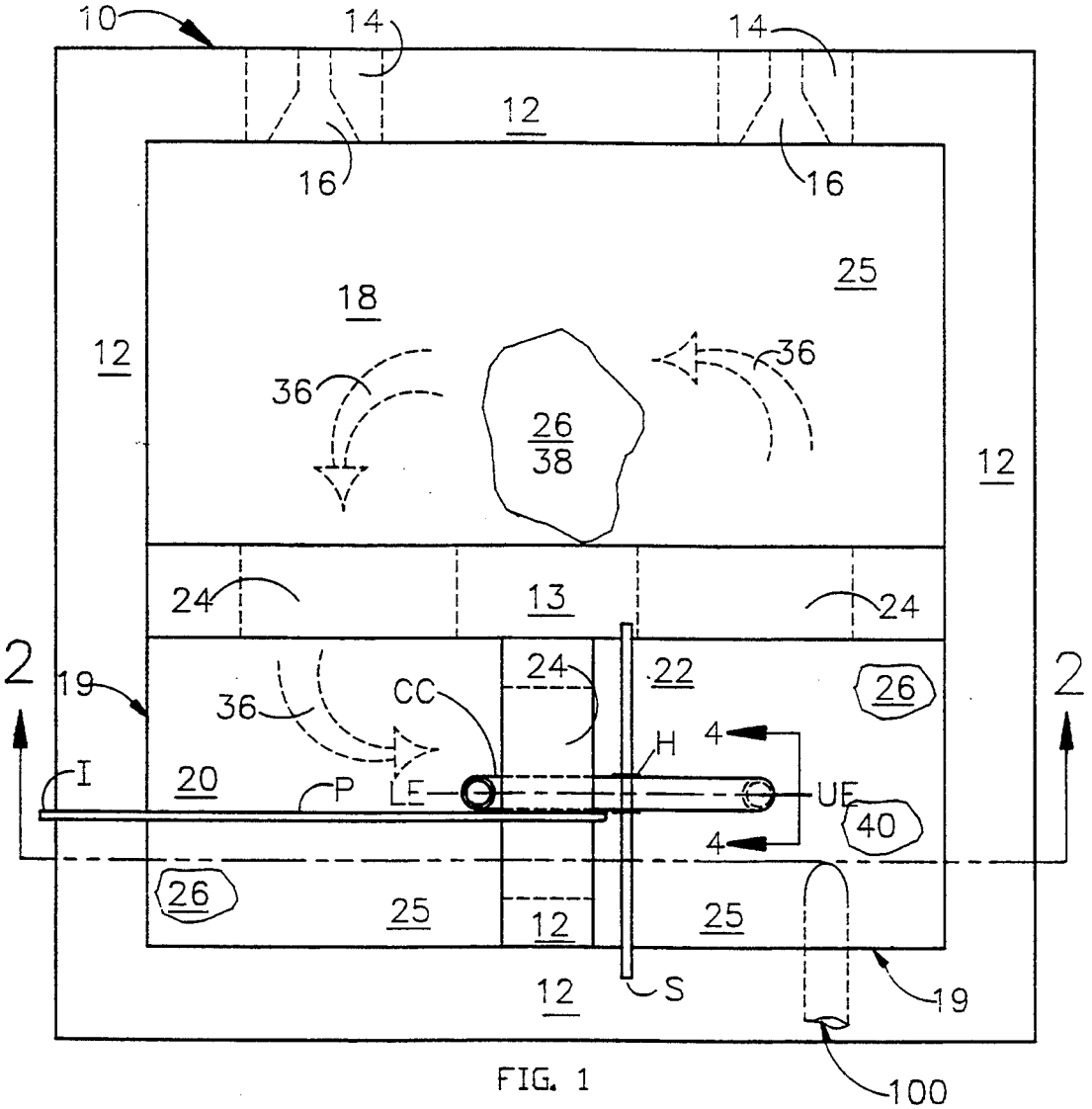
FIG. 1 is a top plan view showing apparatus according to the invention and illustrating the method of the invention in association with a metal-melting furnace, in this case a reverberatory furnace having a main chamber, a circulation well, and a charge well, all in communication, the reverberatory furnace and its associated chambers and wells being shown partially schematically and partially in section, the conveying means of the invention being shown communicating between what is normally the circulation well and the charge well of the reverberatory furnace.

The present invention, in both its method and apparatus aspects, will be more readily understood from the following detailed description, particularly when taken in conjunction with the drawings, in which all of the significant parts are numbered and wherein the same numbers and letters are used to identify the same parts throughout.

A metal-melting furnace, as shown a reverberatory furnace, of refractory material or having the usual refractory lining and fired by combustion burners 14 fed by natural gas or fuel oil which throw flames into the interior of main chamber 18 thereof through flame-introduction means 16, is shown in the FIGS. at 10.

The furnace well comprises bottom wall 11 and side walls 12 and 13, with a mass of molten metal, preferably and usually aluminum or magnesium or an aluminum or magnesium alloy, therein being shown at 26. The base portions 11 of the furnace may be supported on the underlying floor by means of I-beam supports, neither of which are shown. Main chamber 18 is provided with main chamber extensions 19 in the form of what is normally circulation well 20 and charge well 22, connected with each other and with main chamber 18 by means of communicating passageways 24. Molten metal 26, e.g., brass, aluminum, magnesium, titanium, other metals, or alloys thereof, is contained in main chamber 18 and is circulated from the hottest part thereof, indicated at 38, through intermediate well 20 and charge well 22 via communicating passageways 24. A usual circulation means including electrically or otherwise driven motor and its associated circulating means, including associated heat-resistant, e.g., carbide or graphite, impeller, rotor, fan, or blade, may or may not be located in circulation well 20 and, in any event, is not shown because it is conventional in the art and forms no part of the present invention. According to the present invention, the necessary circulation is provided by means of the apparatus of the present invention, namely, the molten metal conveying conduit CC and associated elements, as will be further explained hereinafter, and the presence of a separate circulating means in what is normally the circulation well 20, as for example shown in U.S. Pat. No. 4,702,768 to Pre-Melt Systems, Inc., is rendered dispensable according to the method and apparatus of the present invention, and its presence or absence is therefore strictly optional depending upon the option of the operator in a particular case or depending upon the pre-existence of such equipment. Conveying conduit CC in this case has an inclined central portion and essentially horizontal portions at both ends thereof, being in the shape of a "Z" which has been stretched or flattened.

According to the flow pattern 36 as created by the conveying conduit CC, which provides the circulating means according to the present invention, molten metal 26 in furnace main chamber 18 is constantly and continuously moved from hottest point 38 in main chamber 18, through communicating passageways 24 and especially by means of conveying conduit CC into intermediate well 20, and thence into charge well 22 to approximately the coldest point 40, shown in charge well 22 at the point or a point adjacent to the normal point of introduction of a charge of new or used unmelted chips into charge well 22, as by chip-charging means of any suitable type, as illustrated for example in prior U.S. Pat. No. 4,702,768 or U.S. Pat. No. 4,872,907, the chip-delivery or chip-charging conduit means being shown in shadow lines at 100. The coldest portion of said molten metal pool in charge well 22, indicated by the number 40, is well known to be at or near the point at which fresh or used unmelted metal chips to be melted are introduced into the metal pool 26 in charge well 22, and the necessity of bringing hotter molten metal to this point by maintaining adequate circulation throughout the metal-melting furnace and in all chambers thereof is therefore well understood by one skilled in the art.

Also visible in FIG. 1 are the molten metal oxide 25, which ordinarily collects at the surface of the molten metal pool 26, this being shown in all of the wells of the metal-melting furnace 10.

The molten metal conveying conduit of the invention, whereby the molten metal is conveyed from one place to another in the molten metal bath, is shown as CC, having a lower end LE and an upper end UE, and being supported by hanger H on crossbar support S. The conveying conduit CC may have hanger H attached thereto by suitable high-temperature resistant adhesive, or by welding or the like, or by doughnut-shaped or other clamp, e.g., ring or block means, and in any case by means comprising material which is resistant to the molten metal and the high temperatures employed.

Conveying conduit CC may be supported by a single hanger H or by a plurality of hangers H, for example, one hanger or set of hangers near the bottom and one near the top thereof or, as shown, one on each side of the conveying conduit CC, as most convenient in a particular case. As will be apparent to one skilled in the art, the gas feed means P can be supplied as an internal portion of a hanger H, should that be desired and, when a plurality of hangers are employed at different points on CC, the lowermost-extending of which comprises the inner gas feed means P, it goes without saying that the other and especially the highermost hanger means will not include gas feed means P, since introduction of the inert gas into or adjacent the lower end LE of conveying conduit CC is of the essence of the present invention. Additionally, since the means whereby the hanger or hangers H are secured to the conveying conduit CC is immaterial, so long as it is operative, additional means may employ surrounding rings or blocks, in turn attached to a hanger or hangers H and supported from above by support S or, still alternatively, the means for securing conveying conduit CC to hanger or hangers H may be by suitable molten-metal and heat-resistant clamps which do not totally surround conveying conduit CC but which merely grip it securely at one or both ends. Alternatively, the hanger or hangers H may be supported from a cover positioned above the well or chamber involved, when such cover is included as a part of the metal-melting furnace employed. Due to the fact that the vertical reach of the gas feed means P is also subjected to the molten metal in the pool or bath and to the high temperatures employed, it is likewise advantageously constructed or clad with refractory material, at least to the extent of the portion adapted to be inserted into or submerged in the molten metal pool. For example, pipe P may be of metal clad with ceramic or, even more advantageously, of graphite clad with ceramic.

As shown, gas feed means in the form of a pipe P is shown adjacent to conveying conduit CC, having an inlet port I and an exit port E, the longest horizontal reach of which pipe P is connected to the vertical reach of P by coupling C and the exit port E of which communicates with an inlet to the interior of CC at a lower portion thereof at or adjacent lower end LE thereof by means of a further coupling C. As will be apparent to one skilled in the art, the apparatus of the present invention is disposed within a passageway 24 in vertical wall 12, and thus extends between what is ordinarily circulation chamber 20 and charge well 22 of the metal-melting furnace 10.

By means of inert gas provided through gas feed means P into conveying conduit CC at or adjacent lower end LE thereof, such inert gas being, for example, argon or nitrogen, the introduction and collection of gas bubbles within conveying conduit CC and the upward movement thereof, over the portion thereof which is inclined upwardly from the horizontal, creates a flow of gas in the upward direction toward upper end UE of conveying conduit CC, thereby creating a negative pressure or vacuum behind the gas bubbles in conveying conduit CC and inducing the flow of molten metal 26 into lower end LE of conveying conduit CC and out the upper end UE thereof, the conveying conduit thereby establishing communication between the chambers 20 and 22 and creating the necessary circulation or flow of molten metal 26 in and about the molten metal furnace from the hottest portion 38 thereof to the coldest portion 40 thereof, especially since it is well established that the lower portions of the molten metal mass 26 attain the hottest temperatures. The inert gases emerging from the upper end UE of conveying conduit CC may either be allowed to escape directly to the atmosphere or retained at the surface of the molten metal mass 26 to impede or prevent oxidation thereof or collected by a hood and vented through adequate environmental clean-up equipment and thence to the outside.

Figure 4:
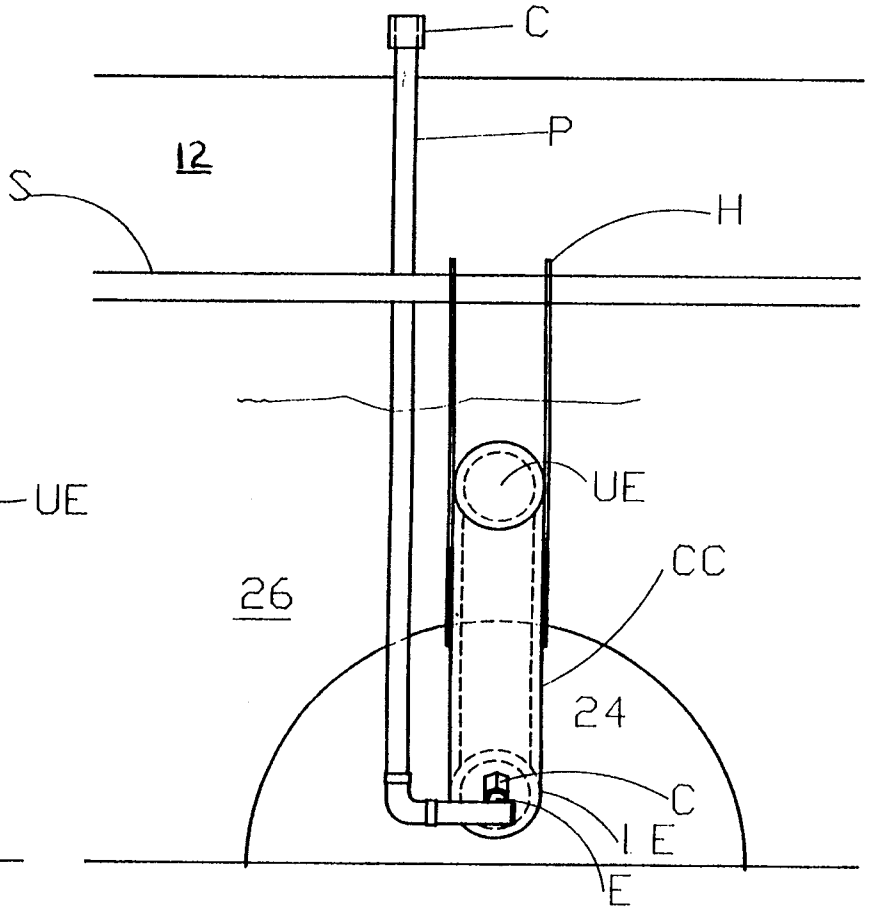
FIG. 4 is an end view of the apparatus of the invention taken along line 4—4 of FIG. 1.
Figure 3:
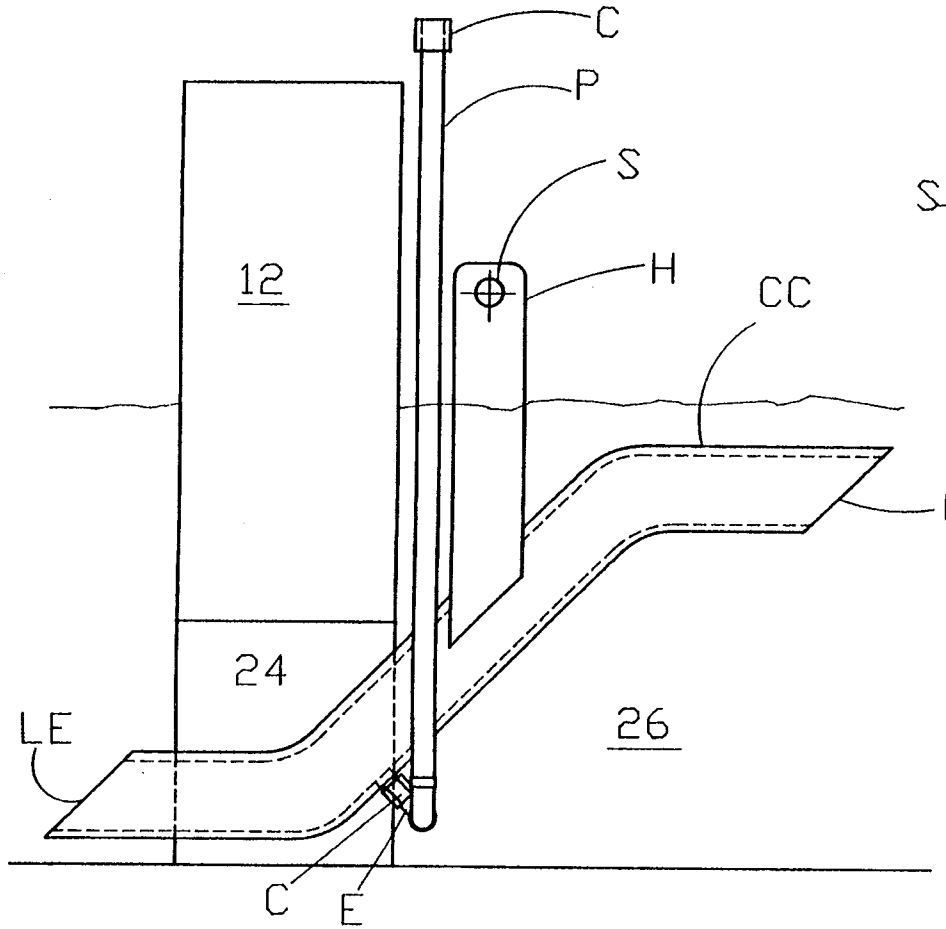
FIG. 3 is an enlarged detail view of the essential elements of the invention as shown in FIG. 2.

The enlarged views of this embodiment of the apparatus of the invention as shown in FIGS. 3 and 4 are given merely for a better understanding of the apparatus of the invention which will be readily understood by one skilled in the art.

The apparatus of the invention depicted in FIGS. 1–4 with its flattened "Z"-shaped design is of special value when a low arch exists in a furnace wall, as shown the divider wall which separates what has heretofore been regarded as the "circulation" well from the "charge" or "feed" well of a metal-melting furnace, or for moving molten metal from a position within the molten metal pool to point outside thereof, e.g., into another furnace, furnace well, ladle, launder, or the like.

Figure 6:
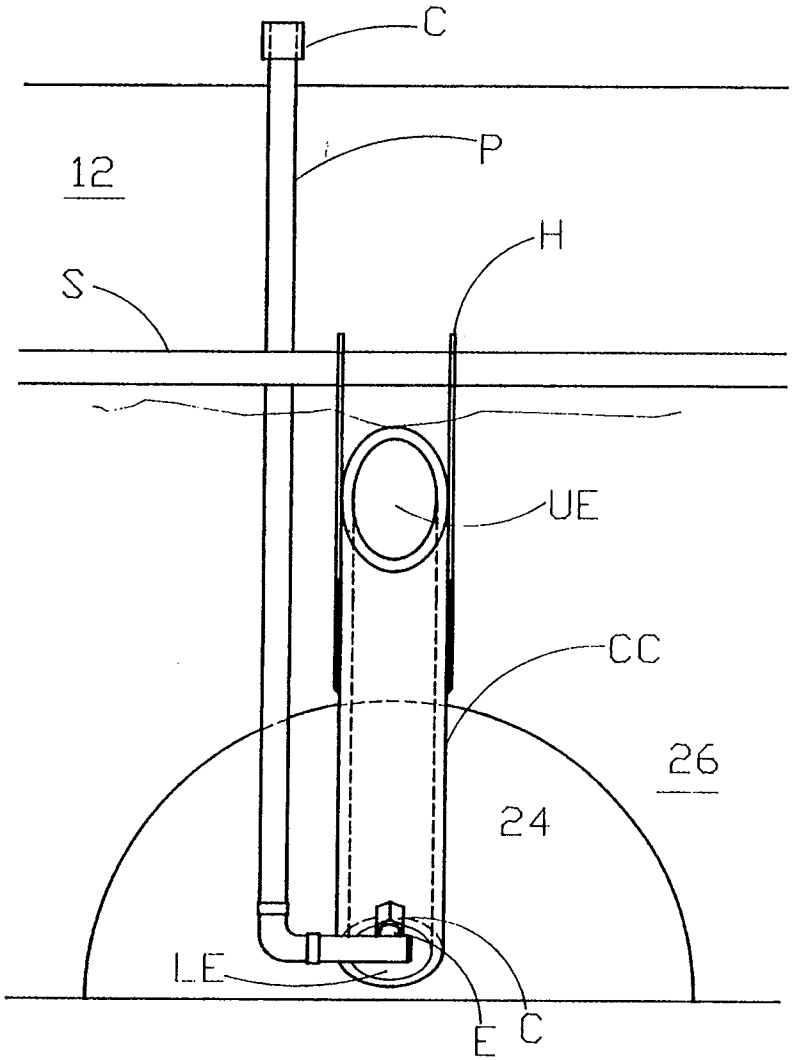
FIG. 6 is like FIG. 4, illustrating another embodiment of the conveying conduit apparatus of the invention.
Figure 5:
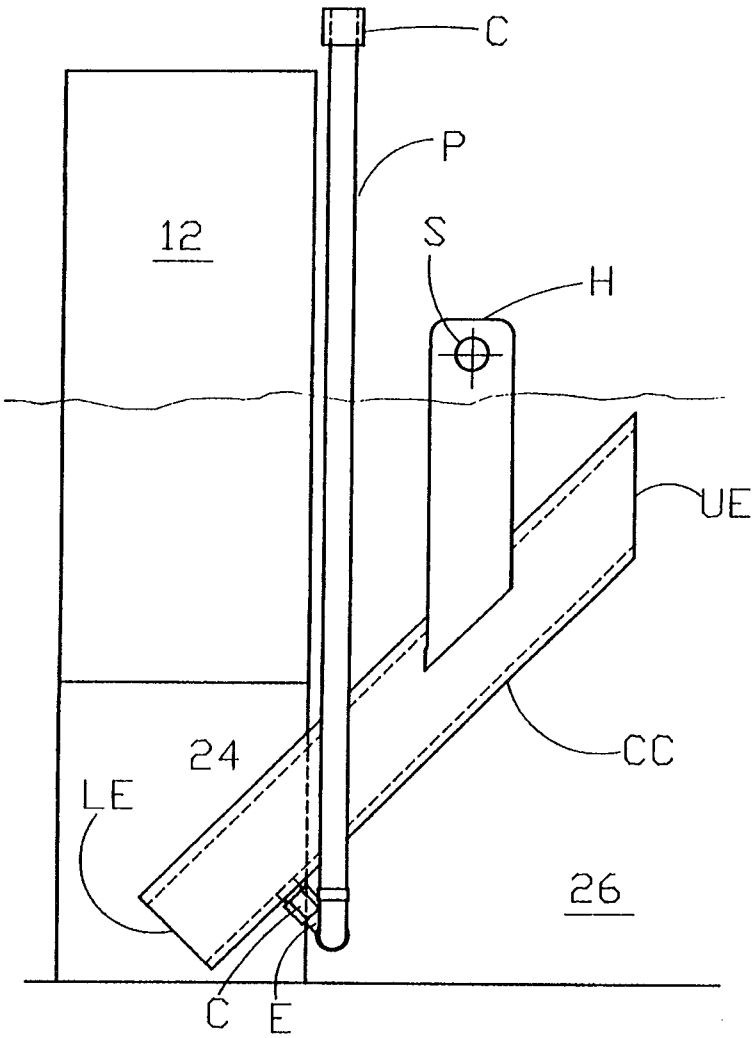
FIG. 5 is like FIG. 3

The different embodiment shown in FIGS. 5 and 6 differs only from the embodiment of the previous figures in having no horizontal segments present in the conveying conduit CC of the embodiment there shown, comprising an inclined reach only, i.e., a reach inclined upwardly from the horizontal.

Figure 2:
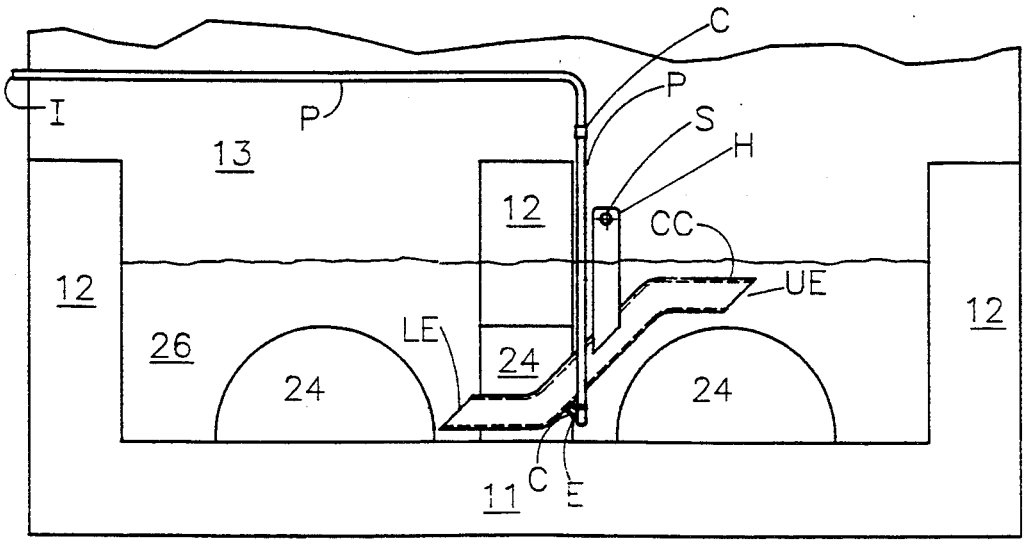
FIG. 2 is a front elevational view taken along line 2—2 of FIG. 1, showing apparatus according to the invention and employed in the method of the invention in location in a mass of molten metal and communicating between the usual circulation well and the charge well of the reverberatory furnace.
Figure 8:
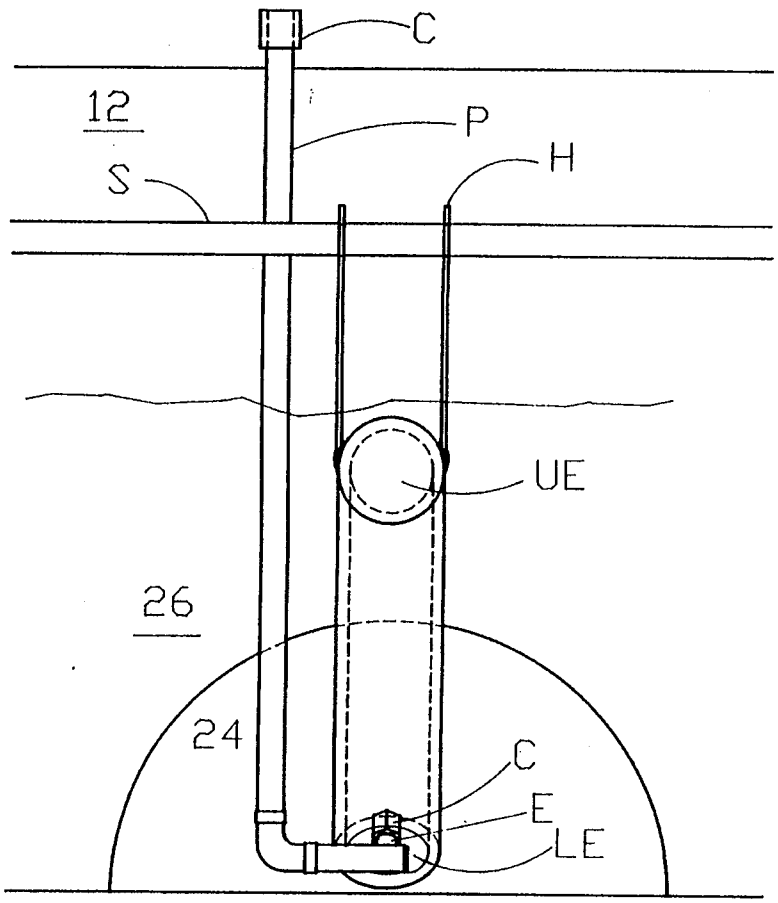
FIGS. 7 and 8 are like FIGS. 3 and 4, illustrating a further embodiment of the conveying conduit apparatus of the invention.
Figure 7:
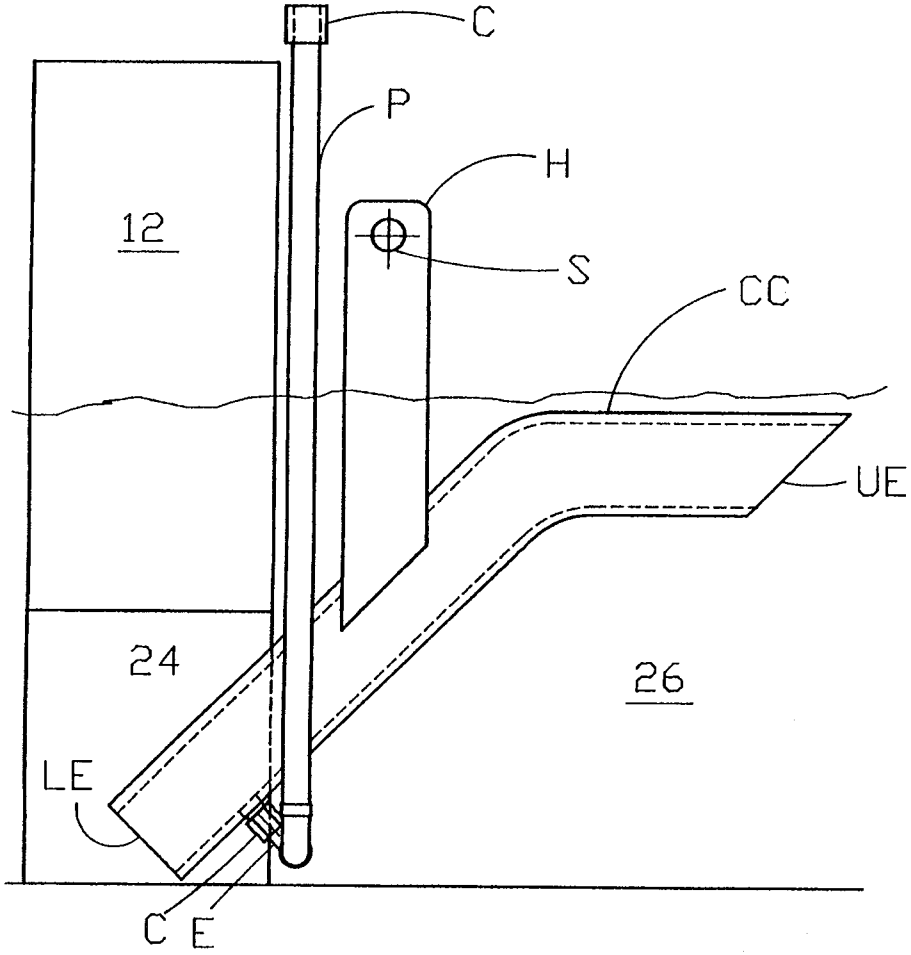

The embodiment of FIGS. 7 and 8 is in all material respects like the embodiment of FIGS. 1–3, but is characterized by a single horizontal reach in the conveying conduit CC of the invention at the upper portion thereof, terminating in the upper end UE thereof, whereas the lower end LE of the conveying conduit CC of this embodiment is located directly at the bottom of the inclined portion and not at the end of an extended horizontal portion or section thereof.

The embodiment of the invention depicted in FIGS. 7 and 8 adds a substantially horizontal upper section to the inclined reach of the conveying conduit depicted in FIGS. 5 and 6.

Figure 10:
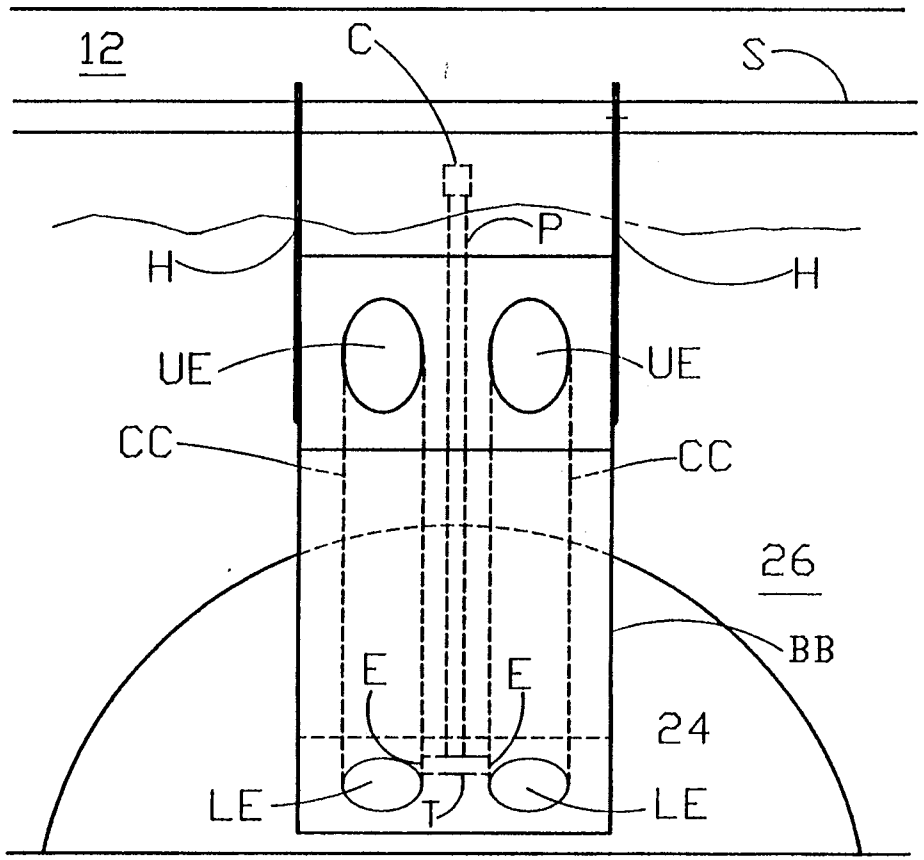
FIGS. 9 and 10 are like FIGS. 3 and 4, illustrating a still further embodiment of the invention in which a double conveying conduit is provided.
Figure 9:
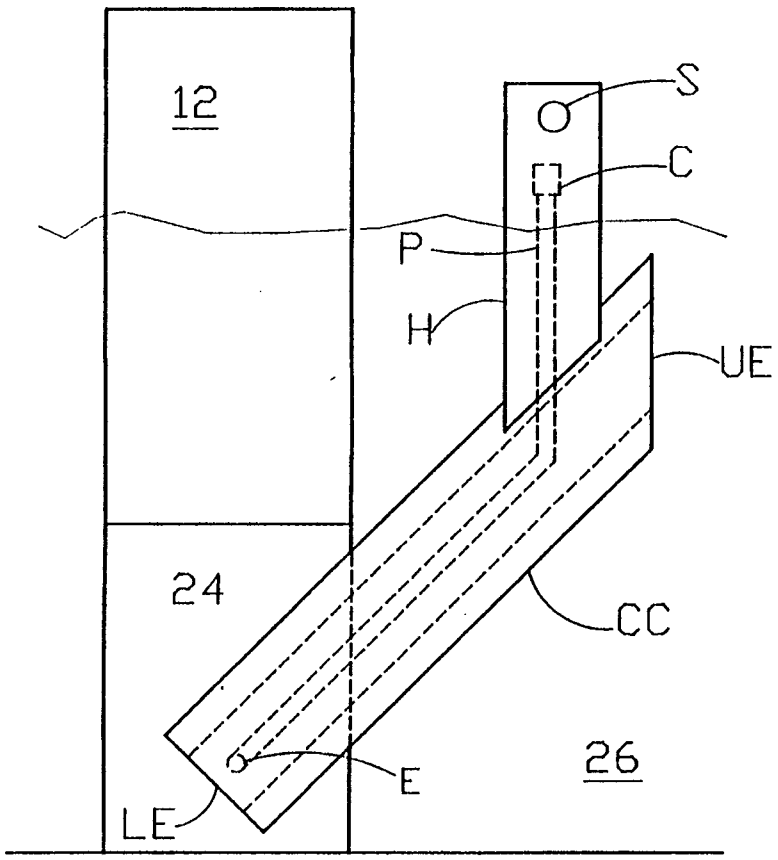

FIGS. 9 and 10 show a further embodiment of the invention, wherein two side-by-side conveying conduits CC are provided, each with its own upper end UE and lower end LE, and wherein the gas feed means P is located between the two conduits CC and communicated thereinto at or near the lower ends LE thereof by means of a T-fitting or T-passageway T, whereby inert gas is brought simultaneously to or near the bottom or lower ends LE thereof from the exit ports E of pipe P. The assembly, including conveying conduits CC, a passageway for pipe P, and either T-fitting or T-passageway T, is molded in or routed out of block BB, of graphite, ceramic, or the like, and block BB is supported by the usual hanger H which is in turn supported at its upper ends by means of cross-bar or similar support S. Once again, the assembly comprising the two side-by-side conveying conduits CC is shown as located between compartments or wells of the metal-melting furnace in a communicating passageway 24 thereof.

The embodiment of FIGS. 9 and 10 is representative of apparatus comprising a plurality, two or more, parallel inclined conveying conduits, with a single gas feed means which "T's" off at the bottom, providing two separate exit ports E therefrom which communicate with the parallel conveying conduits CC at or near the lower ends thereof.

Figure 11:
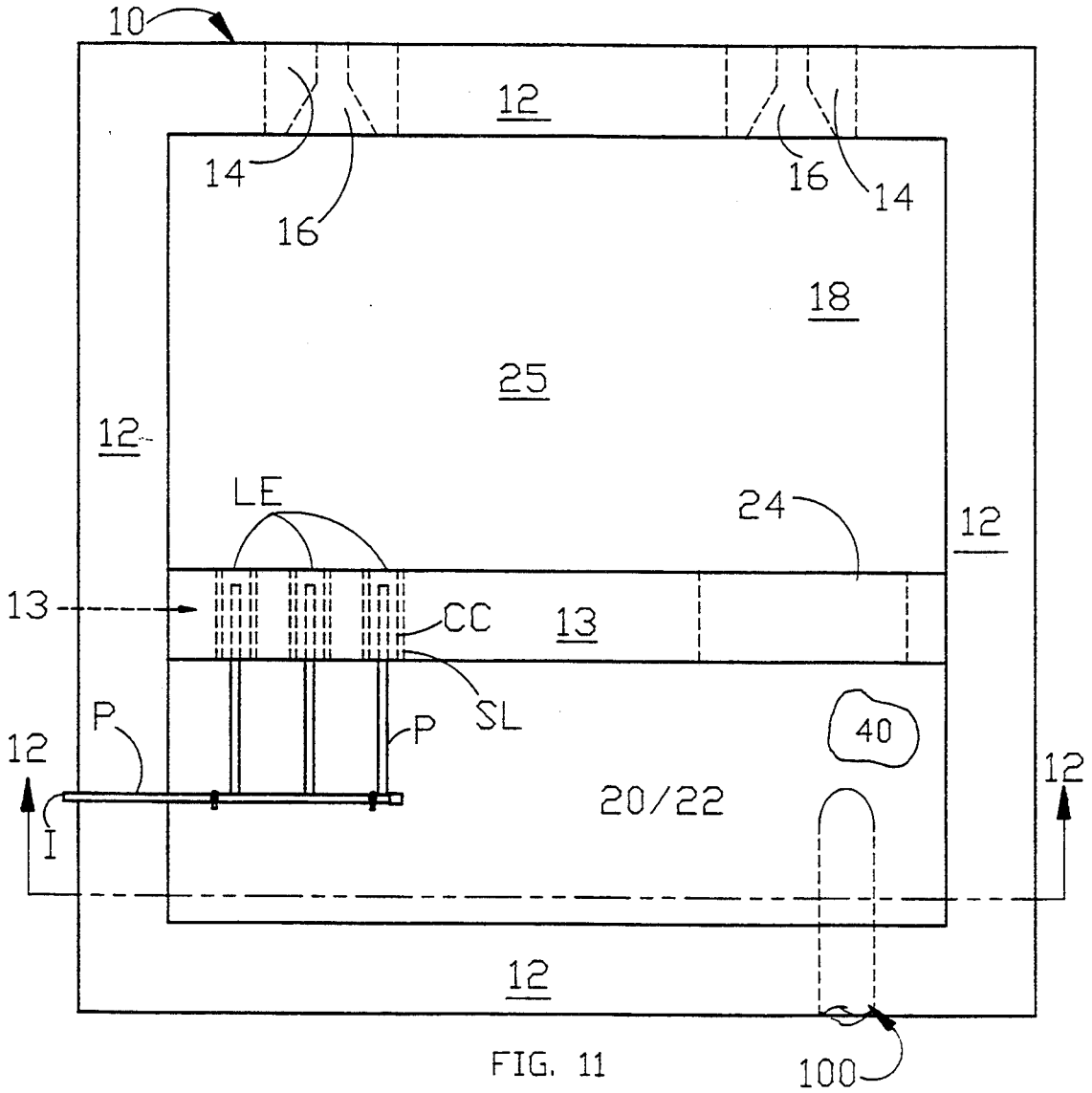
FIG. 11 is like FIG. 1, in abbreviated form, being a plan view of an alternative form of the invention, advantageously employed in carrying out the method of the invention, wherein the conveying conduit is provided in triplicate and is built into a vertical wall separating the main or heating chamber of the furnace from the forward chamber of the furnace, there being no separate circulation well and charge well in the reverberatory furnace depicted.
Figure 12:
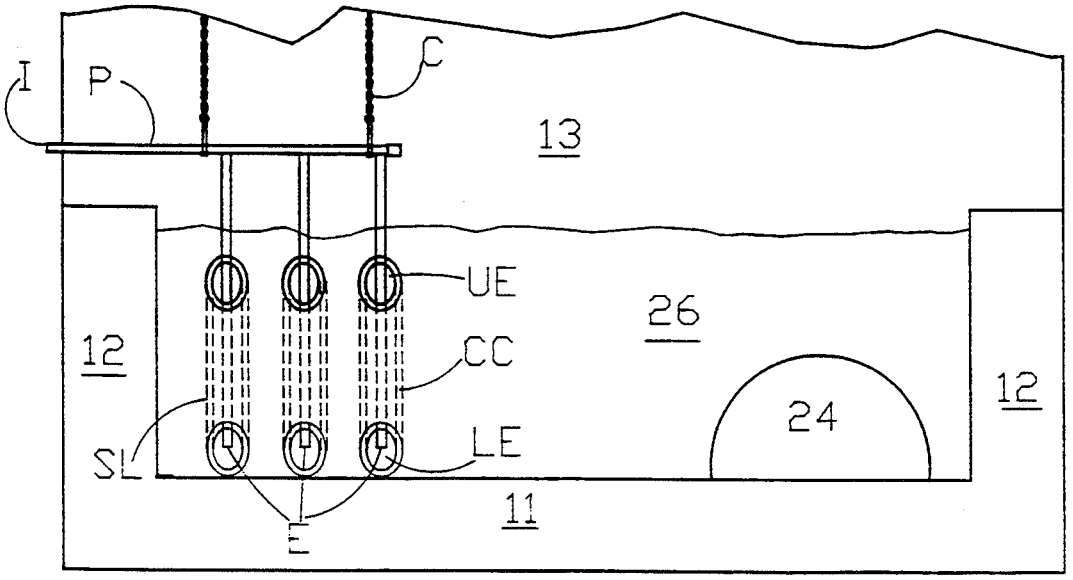
FIG. 12 is a front elevational view along line 12—12 of FIG. 11, showing the triplicate conveying conduit embodiment of the invention from the front.
Figure 13:
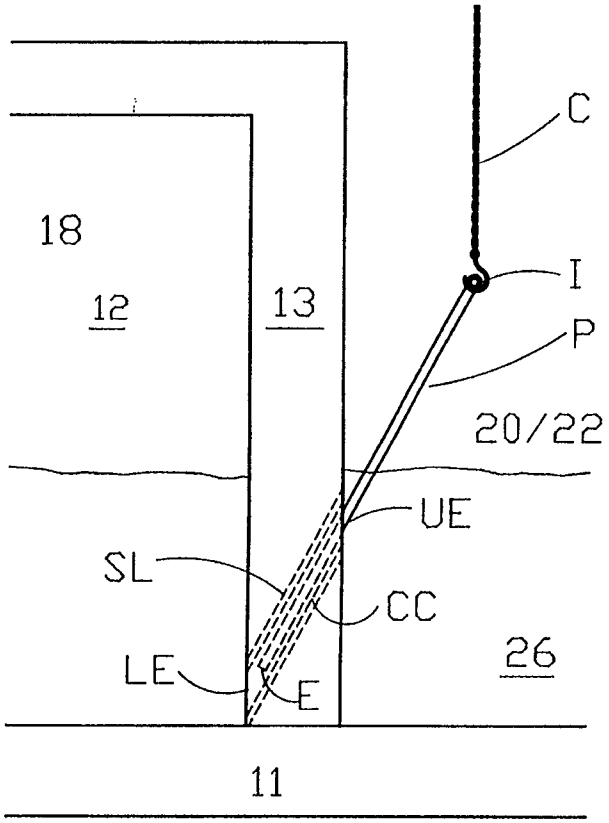
FIG. 13 is a side view of the embodiment of FIGS. 11 and 12 taken along line 13 of FIG. 11.

Referring now to FIGS. 11–13, FIG. 11 is a top plan view of another metal-melting furnace 10, showing only the essentials required to illustrate the apparatus and the method of the present invention.

As seen from FIG. 11, three separate conveying conduits CC are located by preforming or providing tile or like ceramic in the vertical wall 13 between main chamber 18 and forward chamber 20/22 which, in this case, is not further divided into a circulating chamber and a charge well.

These three built-in inclined conveying conduits CC each have their lower end LE located on the side of the wall adjacent main chamber 18 and their upper ends UE located on the side of the wall adjacent forward chamber or well 20/22 and are sleeved into the wall 13 by means of ceramic or other suitable and preferably smooth close-fitting sleeve SL.

Gas feed means in the form of pipe P, having inlet port I and three separate exit ports E, one for each of the three separate conveying conduits CC, is simply supported from above by chain C. In this embodiment, the conveying conduit CC is, as will immediately be apparent, built directly into a wall of the metal-melting furnace 10, and therefore need not be provided as a separate unit, element, or assembly.

As best shown in FIG. 13, the conveying conduits CC are upwardly slanted or inclined from at or near their bottom portion or lower end LE adjacent the forward wall 13 of main chamber 18 and extend upwardly to near the upper surface of the molten metal pool 26 in the forward chamber 20/22.

The embodiment of the invention depicted in FIGS. 11–13 illustrates the apparatus of the invention employing multiple conveying conduits permanently cast into the hot wall, i.e., the wall opposite the combustion burner, of the main chamber of a metal-melting furnace, for the creation of a molten metal flow into the charge well of the metal-melting furnace by introducing gas through the gas feed means, in this case involving a multiple gas manifold as illustrated, through the exit ports thereof into the plurality of conveying conduits with which the exit ports are in communication (actually inserted thereinto) at or near the bottom of the inclined conveying conduits. When necessary, occasional cleaning of the conduits can be readily accomplished, even while the furnace is still hot, by standing above the charge well and manually rodding out the conduits with a simple furnace tool.

Figure 14:
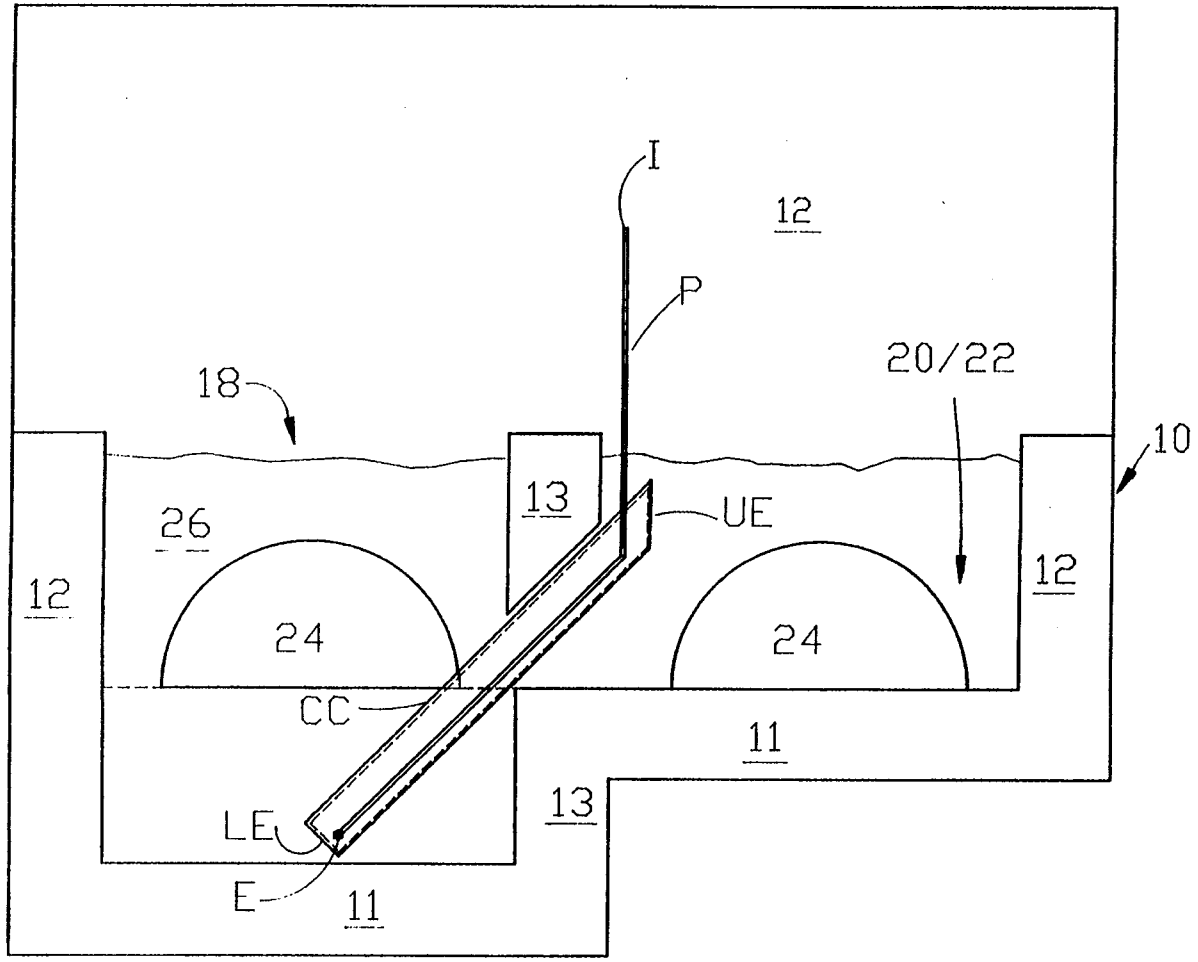
FIG. 14 is like FIG. 13, being a side view of a further embodiment of the invention, wherein the conveying conduit is shown in a metal-melting furnace having a deeper main chamber than its forward chamber, the lower end of the conveying conduit of the invention being located near the bottom of the main chamber and the upper end of the conveying conduit of the invention being positioned in the forward chamber of the furnace which has the shallower depth.

FIG. 14 is a view of another embodiment of the invention like the view of FIG. 13, taken from the side, showing a metal-melting furnace 10 wherein the main chamber of the furnace is of a greater depth than the forward chamber 20/22 thereof. Accordingly, mounting of the conveying conduit CC between main chamber 18 and forward chamber 20/22 through communicating passageway 24 in vertical wall 13, or by building in the conveying conduit CC as in FIGS. 11–13, permits the lower end LE of conveying conduit CC to be located at a considerably greater depth than the upper end UE of conveying conduit CC, thereby permitting greater force to be exerted by the rising inert gas bubbles, which accordingly must travel a greater distance within the inclined conveying conduit CC, thereby imparting or inducing a greater and more positive flow of molten metal from its lower end LE, located in the hot spot near the floor of the main chamber 18 adjacent vertical wall 13, and up to near the surface of the molten metal 26 in forward chamber 20/22 at the upper end UE thereof.

Inert gas is as usual provided through gas feed means in the form of pipe or tube P and from inlet port I and released at exit port E near the lower end LE of the inclined conveying conduit CC. As shown, gas feed means P is located outside of conveying conduit CC and communicates thereinto by means of a fitting or coupling C but, in an alternative embodiment, pipe P can be located interior of conveying conduit CC or can extend to a point below lower end LE of conveying conduit CC, in which case it is preferably provided with an angle just before its exit port E so as to bring the exit port E just below the lower end LE of conveying conduit CC.

The embodiment of FIG. 14 illustrates application of the apparatus and method of the invention in a metal-melting furnace having a special deep well as the main well thereof, which is designed specifically to permit increased vertical head pressure to be achieved, thereby simultaneously to attain significantly-better flow of molten metal from the deeper well to the shallower well.

Figure 15:
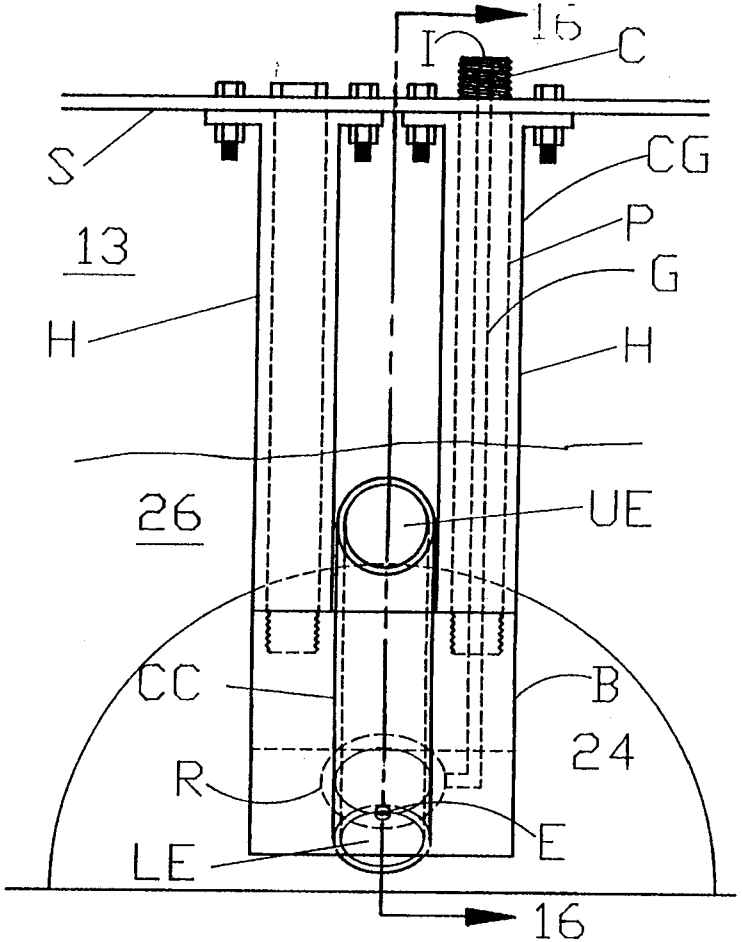
FIG. 15 is an end view, partially in section, like FIG. 4, illustrating another embodiment of the invention in which the conveying conduit is double hung and in which a hanger on one side of the conveying conduit comprises the gas inlet means as its exit port in a hollow circular doughnut surrounding the lower end of the conveying conduit, the said exit port communicating with the interior of the conveying conduit at its lower end.
Figure 16:
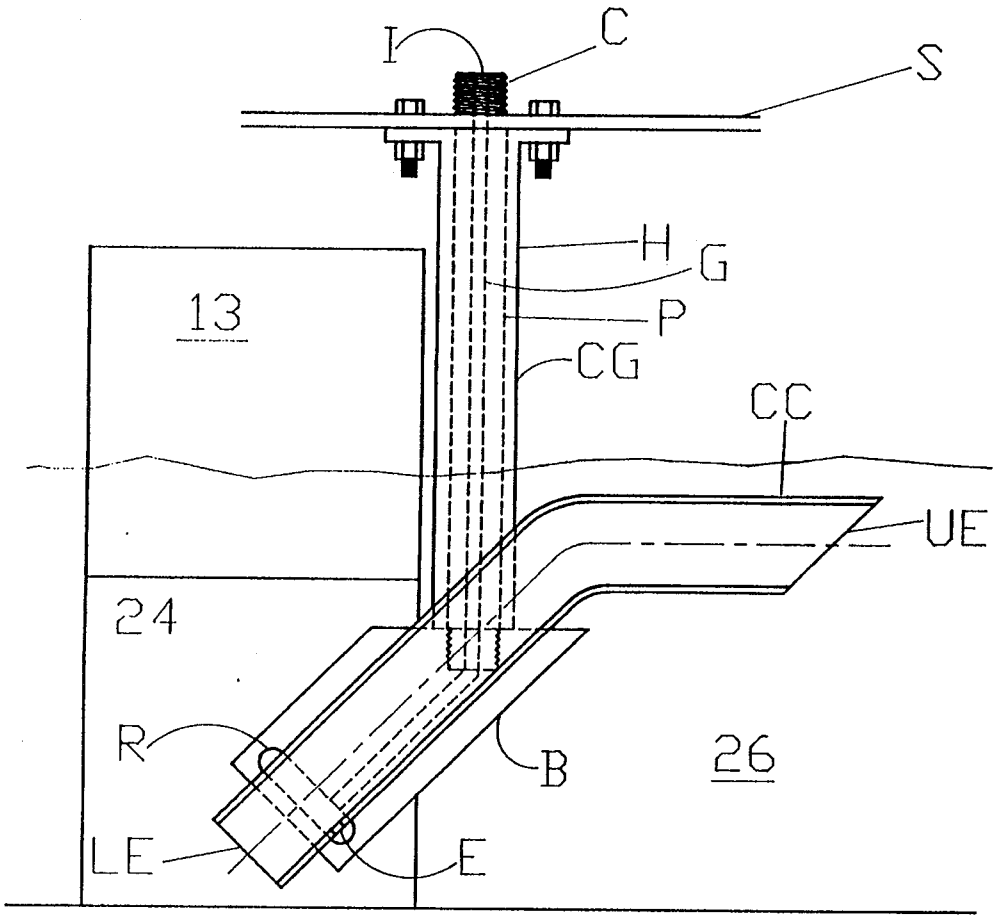
FIG. 16 is a side view of the apparatus of FIG. 15 along the line 16—16 of FIG. 15.

FIGS. 15 and 16 show another embodiment of the invention in which the conveying conduit CC, having an inclined segment or reach and a substantially horizontal reach at the upper end thereof, is double hung by hangers H from a supporting plate S. The apparatus as shown is suspended in the molten metal mass 26 in passageway 24 of wall 13. A coupling C is shown at the top of the vertical reach of the gas inlet means and inlet port I, extending through coupling C communicates with the interior of vertical pipe P constructed in this case of graphite G and clad with ceramic cladding CG. Pipe P is threaded into lower graphite or other refractory block B which comprises a lower extension of the gas inlet means and a passageway constituting a continuation of the interior of pipe P, which passageway terminates in the form of a ring R, being a hollow excavation surrounding conveying conduit CC and comprising the exit port E of the gas feed means, which exit port E, as shown, communicates with an inlet to the interior of conveying conduit CC at the bottom side of the lower end LE thereof. The hanger H at the left-hand side of FIG. 15 is also screwed at its lower end into block B, but does not comprise the additional gas feed means elements just described as being comprised in the right-hand hanger H. Once again, the design of this particular embodiment of the invention is particularly suitable for the movement of a portion of the molten-metal mass or pool from a lower level to a higher level or from within the molten-metal pool to a point outside thereof, as to an adjacent container, ladle, launder, or metal-melting furnace.

Figure 17:
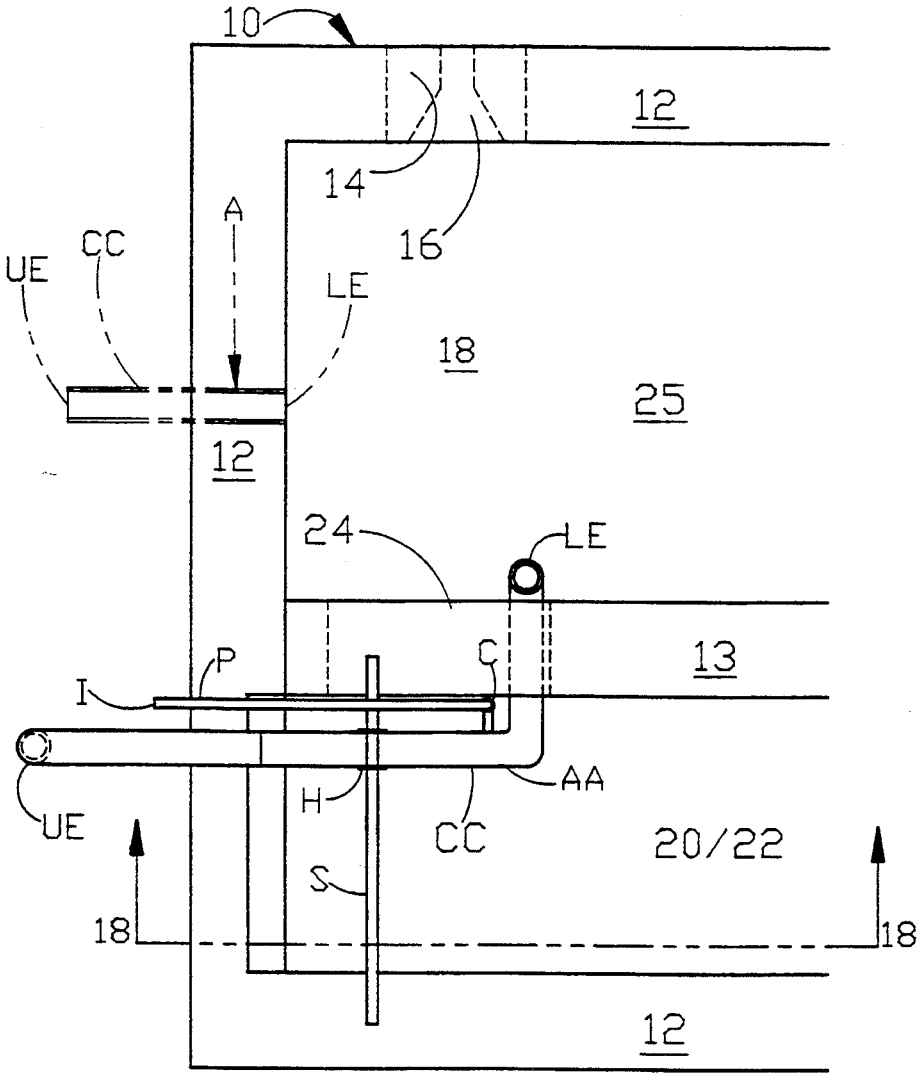
FIG. 17 is a partial top plan view showing another embodiment of the invention, in fact, two separate embodiments of the invention, especially designed for conveying molten metal from within the molten metal pool of a reverberatory furnace to the outside.

Referring now to FIG. 17, this partial top plan view of a reverberatory furnace 10 shows in shadow lines at A a conveying conduit CC having the usual lower end LE and upper end UE, set in place in sidewall 12 of the main chamber 18 of the reverberatory furnace 10, thus leading to the outside. As shown partially broken off in FIG. 18, also in shadow lines, the conveying conduit CC is of the simplest type, having an inclined reach but no horizontal extensions or portions thereof at either its lower or upper ends which, of course, may be optionally provided if in the opinion of the operator or manufacturer any special advantage is to be attained thereby. The gas introduction means employed with this particular conveying conduit CC may conveniently be the same type as shown in detail in FIG. 13, using only a pipe P for introduction of the inert gas into the lower end of the conveying conduit CC in the usual manner as previously described.

Figure 18:
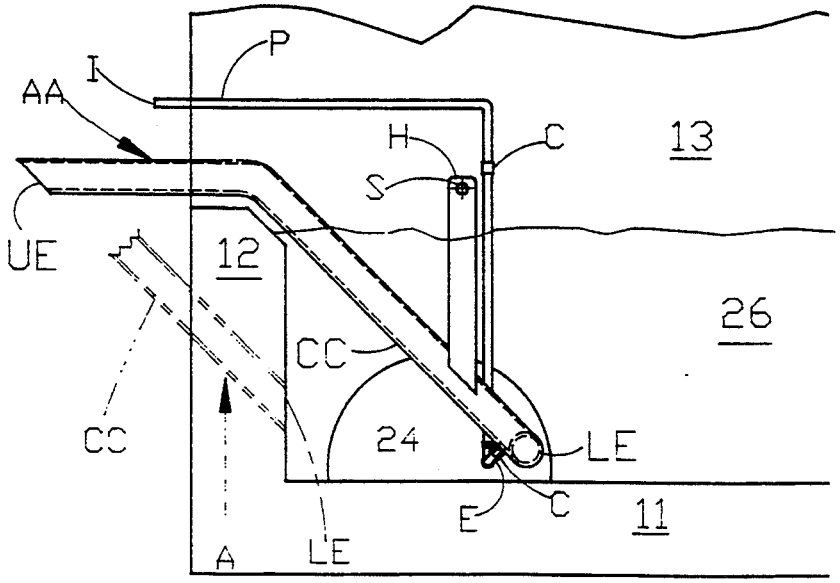
FIG. 18 is a partial front view of the apparatus shown in FIG. 17 along the line 18—18 thereof.

Also shown in FIGS. 17 and 18 is an alternative embodiment AA, again especially arranged for the conveyance of molten metal from out of a molten metal pool of a reverberatory furnace 10 to the outside. In this case, the lower end LE of the conveying conduit CC is located in main chamber 18 and extends through passageway 24 into front chamber 20/22, where it takes a right-hand turn at the commencement of its incline, as best seen in FIG. 18, terminating in a substantially horizontal reach at the end of the incline and leading to its upper end UE above the furnace wall 12 and outside thereof. Gas introduction means in the form of pipe P has its exit port E at a lower portion of conveying conduit CC near the lower end LE thereof, but located so as to be at or near the bottom of the inclined reach thereof. Otherwise, the assembly is essentially the same as shown in previous FIGS. and as previously described, the most noteworthy aspects of the embodiment AA as illustrated in FIGS. 17 and 18 being that the conveying conduit CC is arranged in several different planes, a substantially horizontal plane at the bottom thereof commencing with the lower end LE thereof, an inclined plane at an approximately 45° angle to the first plane commencing at the beginning of the incline thereof, and a parallel substantially horizontal plane at the end of said inclined portion leading to the upper end UE thereof. The conveying conduit CC also lies in a plurality of vertical planes, as shown two separate vertical planes, when viewed from above, namely, the plane in which the lower reach of CC lies and the plane approximately right-angled thereto in which the inclined and upper reaches of the conveying conduit CC lie. The two substantially horizontal segments thereof lie in parallel horizontal planes with the inclined portion lying therebetween being at an approximately 45° angle therewith. It goes without saying that the upper substantially horizontal segment of the conveying conduit CC could also be further angled with respect to the inclined portion thereof, for example, it could lie in a vertical plane angled with respect to the plane of the inclined segment thereof.

Another particularly significant feature of the embodiment AA of FIGS. 17 and 18, as well as certain other embodiments shown and described herein, is the location of the exit port E of the inert gas feed means at the end of pipe P in the lower portion of the conveying conduit CC at or near commencement of the inclined reach thereof, rather than more adjacent to the lowermost end LE thereof, so as better to impart movement to the mass of molten metal by release of the inert gas at the commencement of the inclined portion of the conveying conduit CC, as will be readily understood by one skilled in the art.

Figure 20:
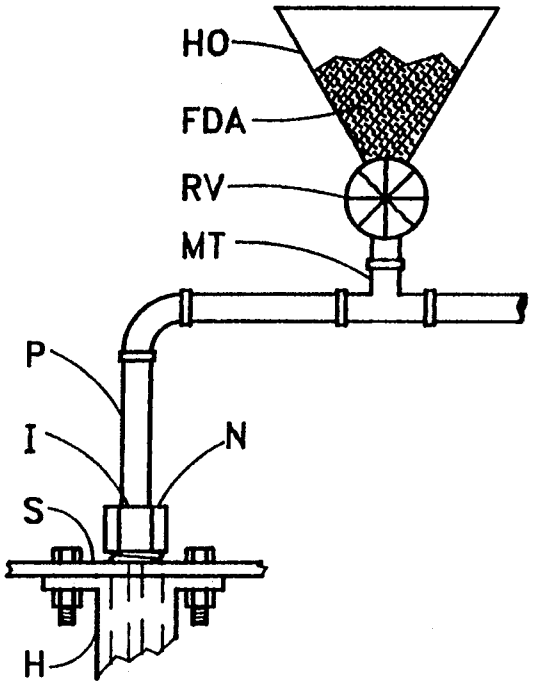
FIG. 20 is a schematic showing the apparatus required for introduction of finely-divided alloying metal into the gas feed means for entrainment in the inert gas.
Figure 19:
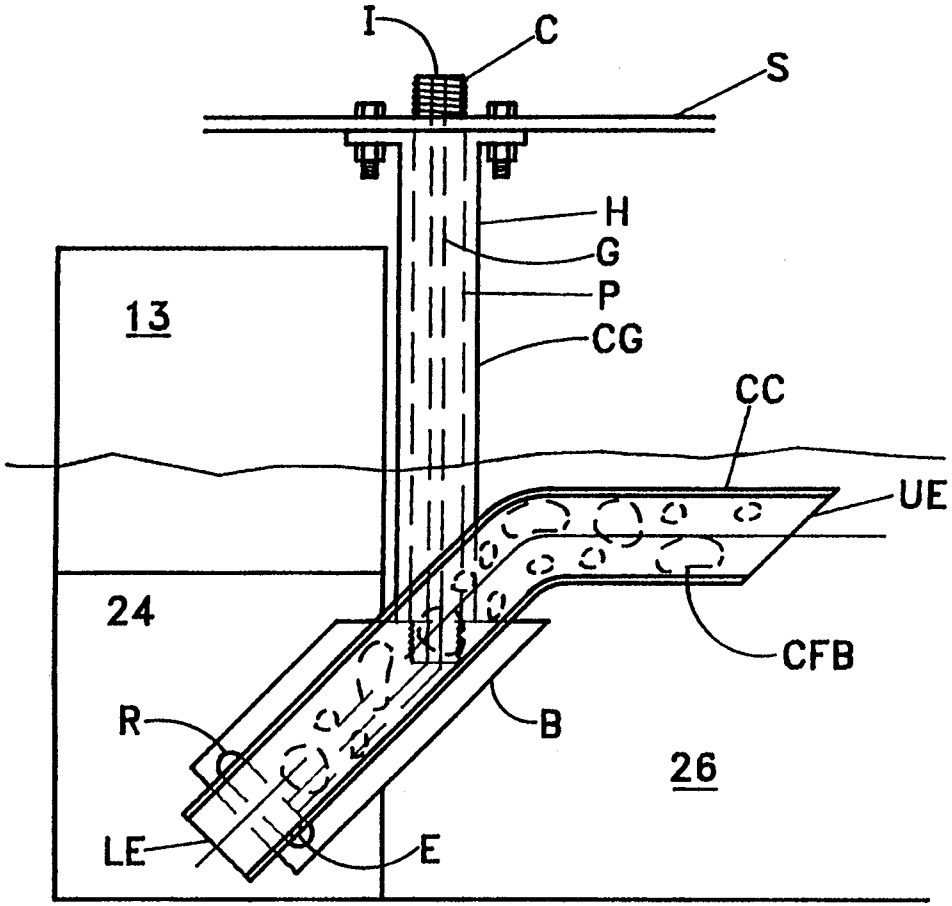
FIG. 19 is a view like FIG. 16 showing bubbles CFB as generated in the conveying conduit CC using a continuous feed of the inert gas.

Reference will be made to FIGS. 19 and 20 and further discussion thereof as to the alloying aspect of the present invention, which occurs simultaneously with the conveying aspect of the present invention, at the end of the section of this application identified as "Operation".

Operation

In operation, the metal-melting furnace, such as the reverberatory furnace described in more detail in the foregoing, is charged with the molten metal mass or pool in any suitable manner. According to past practice, the predried and usually degreased or delacquered metal chips, whether from recycled or new metal, have simply been thrown into a pre-existing molten metal pool in the charge well of the furnace. Such practice has, however, become passe' or obsolete in view of the chip-charging devices or extruding briquetter devices disclosed in Pre-Melt U.S. Pat. Nos. 4,872,907 and 4,702,768. In addition, although metal chips must still be charged into the metal pool in the charge well or charge area of the furnace, it is no longer essential, according to a further Pre-Melt invention, that the chips be degreased or delacquered so long as a non-oxidizing atmosphere is maintained at the surface of the charge well or area and certain exit ports are established for the escape of gas evolved from vaporizable contaminants or impurities present on the chips charged into the molten metal pool which rise to the surface of the pool and usually flame upon entering the ambient air, which provides an oxidizing environment, and may be collected by a hood and associated conduitry and conducted to a point removed from the surface of the molten metal pool for disposal through suitable decontamination equipment before being released into the atmosphere.

In any event, the molten metal pool in the metal-melting furnace is constituted in any suitable or convenient manner, and circulation through the various passageways between the various chambers of the furnace established by employment of the apparatus of the present invention, with or without ancillary circulation equipment of the usual and previously-employed type, as previously described and which, as previously noted, forms no part of the present invention. Due to the proximity of the main chamber to the combustion burners and flame-introduction means usually located in the rear wall of the furnace at the rear of the main chamber, the hottest portion of the molten metal mass is clearly in the main chamber and generally adjacent the front wall of the main chamber. According to the invention, circulation is effected in the molten metal pool by the introduction of an inert gas through appropriate gas feed means having a gas inlet port and a gas exit port, the exit port of which is so located with respect to the lower end of the conveying conduit so as to enable release of gas from said exit port into the conveying conduit. The collection of gas in the conveying conduit and the rise of the accumulated gas bubbles in the conveying conduit induces a concomitant flow of molten metal in the conveying conduit and thereby conveys molten metal mass through the said conveying conduit from a lower level or portion of a well or chamber of the metal-melting furnace to a higher portion or level of the molten metal mass or pool in the same or a different chamber or well of the metal-melting furnace. As shown, a preferred embodiment of the invention involves the employment of the apparatus of the present invention to move a portion of the molten metal mass through the said conveying conduit from one chamber or well of the metal-melting furnace to another, and an especially preferred embodiment of the invention involves the employment of the apparatus of the present invention to move a portion of the molten metal mass from the hottest portion or a hot spot in the molten metal mass or pool to a cooler spot or area, for example, from the main chamber adjacent the forward wall thereof into any adjacent chamber or even out of the molten-metal pool if desired, and another particularly preferred embodiment of the invention involves the employment of the apparatus of the present invention for moving a portion of the molten metal mass from a hotter area or hot spot within the molten metal mass into a cooler portion or area adjacent the normal point of introduction of chips into the molten metal pool, e.g., into the charge well thereof. Moreover, the method of the invention involves the movement or conveyance of a portion of the molten metal mass from a lower portion or area thereof to a higher portion or area thereof, frequently and advantageously through a usual passageway between the various chambers or wells of the metal-melting furnace, or through such apparatus mounted in and/or forming an integral part of a furnace wall, e.g., a wall of the furnace between various chambers or wells thereof, and another particularly preferred embodiment as already stated involves the movement of a portion of the molten metal mass from a hotter portion or area thereof to a colder portion or area thereof, and particularly into the charge well to the point of or adjacent to the point of introduction of chips into the charge well.

By operating in the foregoing manner, whether by the employment of a single conveying conduit or a plural conveying conduit, and whether the conveying conduit or a plurality of conveying conduits are independently mounted in the molten metal mass, for example, in a passageway in a wall between chambers or wells of the metal-melting furnace, or whether a single conveying conduit or a plurality of conveying conduits are mounted directly in the wall or integrally therewith, the necessary circulation of molten metal mass within the metal-melting furnace is readily and conveniently effected and controlled, and portions of the molten metal mass are conveniently moved from a hotter area to a colder area and from a lower level to a higher level and, as already stated and shown in the drawings, from one chamber or well of the metal-melting furnace to another and particularly from a hotter portion of the molten metal mass to a colder portion of the molten metal mass, as in the charge well of the furnace, or even out of the molten-metal furnace if desired.

The improvement in the art of alloying metal according to the present invention involves the employment of the gas-powered molten metal pump or conveying conduit CC as fully described in the foregoing in combination with a suitable means for feeding the finely-divided alloying metal into the inert air stream introduced into the conveying conduit CC. Currently, it is not possible to introduce finely-divided metal into a molten metal mass contained in a melting furnace, because this involves a substantial loss of the alloying metal due to oxidation as well as to a physical airborne loss. Such losses can be as high as thirty percent (30%) when a finely-divided alloying metal is introduced simply by placing it upon the surface of the molten metal mass in a melting furnace and allowing it spontaneously to become a part of the melt.

The gas-powered molten metal pump or conveying conduit CC of the invention provides a means, together with a suitable metering device, for introducing the finely-divided alloying metal below the surface of the molten metal mass, and for thus dispersing the alloying metal in its finely-divided form into a large volume of the molten metal. Because the alloying metal is thus introduced in the absence of oxygen, oxidation is thereby minimized and alloying efficiency greatly increased. Further, the rapid dispersion of the finely-divided alloying metal into the melt ensures a very rapid acceptance of the alloying metal into the melt at the temperatures employed. Each finely-divided metal particle, especially when the alloying metal is in pulverized or powdered form, but even when not-so-fine discrete particles are employed, has a large surface area for heat transfer as opposed to a relatively small surface area for heat transfer when a large piece of alloying metal is employed, as in past practice. Representative operative particle size ranges are, for example, for the alloying metal introduced into the melt, 0.01 to 0.1 inch and preferably 0.25 millimeter to 2.5 millimeter particles, these measurements being taken on the greatest dimension of the particles, although somewhat greater particle sizes are also operative and, as already indicated, alloying metal in powdered or pulverized form is generally preferred. Preferred particle sizes according to U.S. Standard Screen Series are between about 10 mesh and 100 mesh, with smaller size particles in all cases being preferred, since pulverized or powdered alloying metal particles of minimal size on their greatest dimension are more rapidly dissolved in the melt and accepted as a part of the alloy. Moreover, the more rapid melt time per unit weight of alloying metal decreases the necessary alloying time, which results in more available production time for the metal melting furnace and renders the entire process more economic.

Referring now to FIG. 19, which illustrates the molten metal pump as employed for the alloying process of the invention, the device operates with inert gas entering at inert gas inlet I and passing through the passageway of pipe P in hanger H and the surrounding ring R in support block B and thence finally entering the conveying conduit CC through gas exit port or nozzle E. The pressurized gas passing through the gas exit port or nozzle E forms a series of continuous feed bubbles CFB, when the feed of gas is in fact continuous, which pass upwardly through the conveying conduit CC and exit the upper end thereof UE. Additional molten metal enters conveying conduit CC at the lower end LE thereof, filling the conveying conduit CC and being conveyed upwardly to the exit of conveying conduit CC at the upper end UE thereof. When the inert gas is fed at supersonic velocities into the conveying conduit CC, the continuous feed bubbles CFB assume the form of a mass of tiny bubbles SFB (not shown) and, when intermittent or pulsed feed of the inert gas is employed, the bubbles are in the form of relatively spherical bubbles PSB or relatively cylindrical bubbles PCB (neither of which are shown), which types of feed and which types of bubble and inert gas feed modes are not recommended for the present alloying operation, but which are nevertheless operative. Moreover, the employment of multiple nozzles such as shown in FIGS. 10–12 may be employed if desired to increase the rapidity of the alloying operation.

Thus, an improvement or addition to the molten metal pump or conveying conduit CC involves the enhancement of alloying procedure by adding finely-divided alloying metal into the melt by means of the pump or conveying conduit CC. FIG. 20 shows means for so doing in a convenient manner. Referring now to FIG. 20, a schematic of the finely-divided alloying metal, including metal alloy, feed system is shown. The alloying metal to be added in this case is in fact a finely-divided alloy FDA which, prior to its introduction into the molten metal, is held in the alloying metal hopper HO. In this case the alloying metal is a finely-divided magnesium and aluminum alloy FDA. Because the alloying metal is in finely-divided form, it is characterized by a large surface area which promotes rapid melting into and acceptance by the melt, thereby allowing the molten metal mass in the furnace to be alloyed conveniently and rapidly. Upon demand, and at a precise rate, the rotary valve RV, or a similar precision-feed mechanism, is activated automatically or manually to feed a known measured or predetermined amount of the finely-divided alloying metal, in this case the alloy FDA, into the inert gas stream through the mixing tee MT, pipe P, and gas inlet I, connected through coupling C on support plate S by connecting nut N, and thence through hanger H through the interior of vertical pipe P, entering the conveying conduit CC through exit port or nozzle E after passing through surrounding ring R in support block B. The alloying metal FDA is thus entrained in the inert gas and enters into the molten metal 26 in the conveying conduit CC. Because the finely-divided alloying metal FDA is introduced directly into the molten metal mass and immediately submerged therein or surrounded by the molten metal being conveyed and alloyed, it does not have an opportunity to separate out, but commences to melt instantly. The mixing or stirring action created by the gas-powered pump and the movement of the inert gas and molten metal within conveying conduit CC further promotes intimate contact between the finely-divided alloying metal FDA and the molten metal itself. Upon leaving conveying conduit CC at upper end exit UE, the process of alloying the materials or metals is already well underway. The alloying is completed in the metal melting furnace by the time that normal mixing and melting of the molten metal mass in the furnace is normally completed. With proper flow rates, rates of addition, and metal bath temperatures, the alloying process just described can be controlled to provide maximum efficiency and shortest alloying time, thereby realizing not only an excellent alloying result and alloyed product, but considerable further economic advantage from the process, in addition to the obvious advantage of considerable convenience over any known prior-art practice.

In General

The method and apparatus of the present invention is particularly adapted for use in connection with the melting and recycling of nonmagnetic metal scrap such as brass, aluminum, aluminum alloys, and the like, and such nonmagnetic metal scrap may conveniently be separated from a mass of metal scrap including also ferrous, ferric, or other magnetic chips by the employment of magnetic separation means, as is now well known and established in the art.

The conveying conduit of the invention as well as the gas feed means of the invention are generally constructed of high-temperature molten metal-resistant ceramic, graphite, silica, or silicon carbide or the like, and the hangers supporting the same within the metal mass are bonded thereto as by welding, clamping, or ceramic or adhesive bonding around the exterior thereof or in some cases may be molded into the ceramic, graphite, silica, or silicon carbide material of construction, or in some cases may even be of mild or stainless or such steel coated or plated with a refractory material.

Where, in this Specification and claims, molten metal, a molten metal mass or pool, and "metal chips" are often referred to, the type of metal in the molten metal pool has already been described, and the term "metal chips" is to be understood as encompassing metal chips of various almost unlimited proportions, configurations, and dimensions, but particularly as including small pieces and/or particles, likewise of extremely variable dimensions, and in general the term "metal chips" is employed herein as having the usual meaning to one skilled in the art, being inclusive not only of parts, pieces, particles, and fragments of the usual type from scrap, but also previously-unused metal in standard or odd configurations remaining from previous molding, extruding, casting, rolling, or like metal processing operations, and it goes without saying that inconveniently large pieces can be reduced in size in any convenient manner and employed as metal chips and that, accordingly, any suitable metal, whether scrap or otherwise, can be converted into chips and employed in the method and apparatus of the invention, whether new metal or previously used metal, including even and especially new and used aluminum sheet and can scrap, when it is determined that such further processing into new metal is required or desired by the operator.

It is thereby seen from the foregoing that the objects of the present invention have been accomplished and that a novel, efficient, and economic method has been provided for the conveyance of a portion of the molten metal mass or pool in a metal-melting furnace employing only an inclined conveying conduit and associated gas feed means through which an inert gas is introduced, the flow of gas into and up the incline of the conveying conduit inducing flow of a portion of the molten metal mass upwardly along the inclined conveying conduit and thereby providing a novel method for providing circulation within the molten metal mass in a metal-melting furnace, including the conveyance of a portion of the molten metal mass from a lower area of the mass to an upper area or level of the mass, from one chamber of the metal-melting furnace to another, from a hotter area of the molten metal mass to a cooler area of the molten metal mass, or even out of the molten metal pool and to an adjacent container, ladle, launder, or furnace if desired, all as described in the foregoing, as well as apparatus for use in carrying out the said process, and whereby all of the previously-mentioned advantages have been attained and the shortcomings of the prior art have been obviated. According to the method and means provided by the present invention, the disadvantages and shortcomings associated with previous methods and means for the alloying of a molten metal are likewise eliminated, since the alloying can be efficiently and economically carried out simultaneously with the conveyance of the molten metal as fully set forth in the foregoing.

Although the preferred embodiments of the invention have been illustrated in the accompanying drawings and described in the foregoing description, it is to be understood that the invention is not limited to the embodiments disclosed or to the exact details of operation or exact compounds, compositions, methods, or procedures shown and described, inasmuch as the invention is capable of numerous modifications, rearrangements, and substitutions of parts and elements and other equivalents, whether metallurgical, chemical, or mechanical, without departing from the spirit or scope of the invention, as will readily be apparent to one skilled in the art, wherefore the present invention is to be understood as limited only by the full scope which can be legally accorded the appended claims.

I claim:

1. Molten metal conveying means suitable for conveying molten metal from one place to another in a molten metal pool or mass in a metal-melting furnace or out of said molten metal pool, while simultaneously alloying the same, comprising in combination:

inert gas feed means having a gas inlet port and a gas exit port, at least a portion thereof adapted to be submerged in a molten-metal bath comprising high-temperature and molten-metal resistant material, means for entraining finely-divided alloying metal in said inert gas, an elongated conveying conduit of high-temperature molten-metal resistant material having a lower end and an upper end, at least a portion of said conduit being inclined upwardly from the horizontal, the exit port of said inert gas feed means being associated with said conveying conduit at or near the lower end thereof so as to enable release of inert gas from said exit port of said gas feed means into said conveying conduit at or adjacent a lower end thereof, thereby to induce concomitant flow of molten metal in said conveying conduit and simultaneous alloying of the molten metal mass.

2. The means of claim 1, adapted to be mounted in a molten metal pool in the interior of a metal-melting furnace.

3. The means of claim 1, supported in place in a molten metal mass or pool in a metal-melting furnace.

4. The means of claim 3, wherein the molten metal mass or pool is in a metal-melting furnace having one chamber deeper than another chamber, and wherein the lower end of said conveying conduit is in the deeper chamber and the upper end of said conveying conduit is in said shallower chamber.

5. The means of claim 1, mounted in a passageway in a wall between chambers or wells of a metal-melting furnace.

6. The means of claim 1, built into a wall between chambers or wells of a metal-melting furnace.

7. The means of claim 1, comprising a single conveying conduit.

8. The means of claim 1, comprising a plurality of conveying conduits.

9. The means of claim 1, comprising a plurality of conveying conduits and wherein said gas feed means communicates with said plurality of conveying conduits at or near the lower end thereof.

10. The means of claim 6, wherein the conveying conduit is supported in said wall by means of a sleeve around the exterior thereof.

11. The means of claim 1, wherein the exit port of said gas feed means is in communication with the interior of the conveying conduit at or adjacent the lower end thereof.

12. The means of claim 1, wherein the conveying conduit has an inclined reach from its lower end to its upper end.

13. The means of claim 1, wherein the conveying conduit has an inclined reach and a substantially horizontal reach.

14. The means of claim 1, wherein the conveying conduit has an inclined reach and a substantially horizontal reach at the upper end thereof.

15. The means of claim 1, wherein the conveying conduit has an inclined reach and a substantially horizontal reach at both the upper end thereof and the lower end thereof.

16. The means of claim 15, wherein the conveying conduit is in the form of a flattened Z.

17. The means of claim 1, wherein a portion of the gas feed means is comprised as a part of a hanger adapted to support the conveying conduit in a molten metal pool.

18. The means of claim 1, wherein the gas feed means comprises a block which supports said conveying conduit, said block having therein a passageway comprising the exit port of said gas feed means.

19. The means of claim 18, wherein said passageway is a circular passageway surrounding said conveying conduit and wherein said exit port is located in said circular passageway.

20. The means of claim 1, wherein the conveying conduit has an inclined reach and a substantially horizontal reach at an end of said inclined reach, and wherein the inclined reach and the substantially horizontal reach lie in different vertical planes.

21. The means of claim 1, wherein the conveying conduit has an inclined reach and a substantially horizontal reach at a lower end thereof, and wherein inert gas is introduced into said conveying conduit at or near the bottom or commencement of its inclined reach.

22. The means of claim 1, wherein the conveying conduit is at least partially in the form of a passageway in a block of refractory material.

23. The means of claim 22, comprising a plurality of conveying conduits at least partially in the form of passageways in a block of refractory material.

24. The means of claim 22 or 23, wherein the gas inlet means also at least partially comprises a passageway in said block of refractory material.

25. The means of claim 1, wherein the inert gas feed means is adapted to provide a pressure of inert gas at the exit port of the inert gas feed means of up to about 150 psi.

26. The means of claim 1, wherein the inert gas feed means is adapted to provide a pressure of inert gas at the exit port of the inert gas feed means of between about 20 and about 60 psi.

27. The means of claim 1, wherein the means for entraining the finely-divided alloying metal in said inert gas is adapted to entrain an alloying metal selected from the group consisting of silicon, strontium, magnesium, manganese, iron, chromium, titanium, zinc, copper, and admixtures or alloys thereof.

28. The means of claim 1 or 27, wherein the means for entraining the finely-divided alloying metal in said inert gas is adapted to entrain the alloying metal in pulverized or powder form.

29. The means of claim 1 or 27, wherein the means for entraining the finely-divided alloying metal is adapted to entrain the alloying metal in the form of particles having a particle size of 0.01 to 0.1 inch on their greatest dimension.

30. The means of claim 1, wherein the means for entraining the finely-divided alloying metal is adapted to entrain the alloying metal in the form of particles having a particle size of about 0.25 millimeter to about 2.5 millimeters on their greatest dimension.

31. The means of claim 1, wherein the means for entraining the finely-divided alloying metal is adapted to entrain the alloying metal in the form of particles having a particle size between 10 mesh and 100 mesh (U.S. Standard Screen Series).

* * * * *